US007931549B2

(12) United States Patent
Pearson et al.

(10) Patent No.: US 7,931,549 B2
(45) **Date of Patent: *Apr. 26, 2011**

(54) ICE HOCKEY STICK

(75) Inventors: Robert Timothy Pearson, Banning, CA (US); Vincent Drouin, Terrebonne (CA)

(73) Assignee: Sport Maska Inc., Montreal, QC (CA)

( * ) Notice: Subject to any disclaimer, the term of this patent is extended or adjusted under 35 U.S.C. 154(b) by 0 days.

This patent is subject to a terminal disclaimer.

(21) Appl. No.: 12/512,982

(22) Filed: Jul. 30, 2009

(65) Prior Publication Data

US 2011/0028250 A1 Feb. 3, 2011

(51) Int. Cl.
*A63B 59/14* (2006.01)

(52) U.S. Cl. ..... 473/560

(58) Field of Classification Search ..... 473/560–563
See application file for complete search history.

(56) References Cited

U.S. PATENT DOCUMENTS

| | | | | |
|---|---|---|---|---|
| 649,146 | A | | 5/1900 | Tice |
| 1,459,389 | A | | 6/1923 | Brown |
| 2,040,132 | A | * | 5/1936 | Hall ..... 473/560 |
| 2,596,894 | A | | 5/1952 | Frisch |
| 3,702,702 | A | | 11/1972 | Hoult |
| 3,844,555 | A | | 10/1974 | Tremblay |
| 3,934,875 | A | | 1/1976 | Easton et al. |
| D244,790 | S | | 6/1977 | Carlson et al. |
| 4,159,114 | A | | 6/1979 | Ardell et al. |
| 4,200,479 | A | | 4/1980 | Ardell et al. |
| 4,353,549 | A | | 10/1982 | Goupil et al. |
| 4,684,130 | A | | 8/1987 | Drolet et al. |
| 4,739,994 | A | | 4/1988 | Lewis, Jr. |
| 4,940,243 | A | | 7/1990 | Tucker et al. |
| 5,007,652 | A | | 4/1991 | Tucker et al. |
| 5,048,843 | A | | 9/1991 | Dorfi et al. |
| 5,082,290 | A | | 1/1992 | Tucker et al. |

(Continued)

FOREIGN PATENT DOCUMENTS

| | | |
|---|---|---|
| CA | 896691 | 3/1972 |

(Continued)

OTHER PUBLICATIONS

Title: deBeer Women's 803 Octogonal Lacrosse Shaft, printed from http://www.dickssportinggoods.com/sm-debeer-womens-803-octogonal-lacrosse-shaft--pi-2146177.html.

(Continued)

*Primary Examiner* — Mark S Graham
(74) *Attorney, Agent, or Firm* — Osler, Hoskin & Harcourt LLP

(57) ABSTRACT

An ice hockey stick has a shaft and an adjoining blade. The shaft has a proximal end proximate the blade, a distal end opposite the proximal end, and an outer surface. The outer surface has a generally rectangular cross-sectional shape transitioning towards the proximal end to one of a generally hexagonal, octagonal, decagonal, or dodecagonal cross-sectional shape, and a front shaft face and an opposing rear shaft face. A width of a portion of the shaft, as measured between the front shaft face and the rear shaft face, tapers towards the proximal end. The blade has a front blade face flush with the front shaft face and a rear blade face opposing the front blade face. The rear blade face is flush with the rear shaft face. The blade also has a heel and a neck affixed to the proximal end of the shaft.

21 Claims, 15 Drawing Sheets

U.S. PATENT DOCUMENTS

| | | | |
|---|---|---|---|
| 5,603,498 | A | 2/1997 | Crawford et al. |
| 5,651,744 | A | 7/1997 | Millon et al. |
| 5,674,140 | A | 10/1997 | Tucker et al. |
| 5,718,647 | A | 2/1998 | Tiitola |
| D404,449 | S | 1/1999 | Burger |
| D406,625 | S | 3/1999 | Hutzenlaub |
| D412,544 | S | 8/1999 | Burger |
| 5,967,913 | A | 10/1999 | Sulenta |
| 6,033,327 | A | 3/2000 | Bird |
| 6,033,328 | A | 3/2000 | Bellefleur et al. |
| D430,249 | S | 8/2000 | Burger |
| 6,129,962 | A | 10/2000 | Quigley et al. |
| 6,241,633 | B1 | 6/2001 | Conroy |
| 6,267,697 | B1 | 7/2001 | Sulenta |
| 6,500,079 | B1 | 12/2002 | Tucker, Sr. |
| D484,555 | S | 12/2003 | Bellefleur et al. |
| 6,752,730 | B1 | 6/2004 | Brine, Jr. et al. |
| D496,703 | S | 9/2004 | Gans |
| D504,929 | S | 5/2005 | Bellefleur et al. |
| 6,960,144 | B2 | 11/2005 | Tucker, Sr. |
| 7,097,577 | B2 | 8/2006 | Goldsmith et al. |
| 7,108,616 | B2 | 9/2006 | Morrow et al. |
| D531,243 | S | 10/2006 | Davis |
| D534,227 | S | 12/2006 | Lee |
| 7,144,343 | B2 | 12/2006 | Goldsmith et al. |
| 7,201,678 | B2 | 4/2007 | Filice et al. |
| D544,932 | S | 6/2007 | Scott |
| 7,232,386 | B2 | 6/2007 | Halko et al. |
| 7,282,000 | B2 | 10/2007 | Brine, III et al. |
| 7,285,063 | B2 | 10/2007 | Lussier et al. |
| D556,281 | S | 11/2007 | Bamber |
| 7,326,135 | B2 | 2/2008 | Lussier et al. |
| D594,920 | S | 6/2009 | Drouin et al. |
| D595,368 | S | 6/2009 | Drouin et al. |
| D595,792 | S | 7/2009 | Drouin et al. |
| 2002/0128094 | A1 | 9/2002 | Manory |
| 2004/0087395 | A1 | 5/2004 | Manory |
| 2004/0121864 | A1 | 6/2004 | Morrow et al. |
| 2005/0064964 | A1 | 3/2005 | Filice et al. |
| 2005/0079935 | A1 | 4/2005 | Morrow et al. |
| 2005/0137037 | A1 | 6/2005 | Tucker, Sr. |
| 2005/0209029 | A1 | 9/2005 | Morrow et al. |
| 2005/0215363 | A1 | 9/2005 | Lussier et al. |
| 2005/0215364 | A1 | 9/2005 | Lussier et al. |
| 2005/0277494 | A1 | 12/2005 | Goss |
| 2005/0282666 | A1 | 12/2005 | Morrow |
| 2005/0282667 | A1 | 12/2005 | Morrow |
| 2006/0046866 | A1 | 3/2006 | Rigoli |
| 2006/0247077 | A1 | 11/2006 | Deetz |
| 2007/0004541 | A1 | 1/2007 | Price et al. |
| 2007/0010358 | A1 | 1/2007 | Filice et al. |
| 2007/0049431 | A1 | 3/2007 | Meyer et al. |
| 2007/0135244 | A1 | 6/2007 | Lee |
| 2007/0184923 | A1 | 8/2007 | Morrow |
| 2007/0270255 | A1 | 11/2007 | Morrow et al. |
| 2007/0287561 | A1 | 12/2007 | Rigoli |
| 2008/0026882 | A1 | 1/2008 | Main |

FOREIGN PATENT DOCUMENTS

| | | | |
|---|---|---|---|
| CA | 1180728 | | 1/1985 |
| CA | 1205835 | | 6/1986 |
| CA | 1215406 | | 12/1986 |
| CA | 1219886 | | 3/1987 |
| CA | 1273662 | A1 | 9/1990 |
| CA | 1317610 | | 5/1993 |
| CA | 2091630 | | 9/1994 |
| CA | 2106178 | | 3/1995 |
| CA | 2117962 | | 4/1995 |
| CA | 2071158 | A1 | 2/1996 |
| CA | 2138715 | | 1/1999 |
| CA | 2382571 | | 3/2000 |
| CA | 2158898 | | 3/2001 |
| CA | 2428217 | | 5/2002 |
| CA | 2451911 | | 1/2003 |
| CA | 2358307 | | 4/2003 |
| CA | 2481072 | | 3/2005 |
| CA | 2462333 | | 9/2005 |
| CA | 2502538 | | 9/2005 |
| CA | 2502630 | | 9/2005 |
| CA | 2502642 | | 9/2005 |
| CA | 2558046 | | 9/2005 |
| CA | 2506213 | | 11/2005 |
| CA | 2485420 | | 1/2006 |
| CA | 2535206 | A1 | 2/2006 |
| CA | 2575460 | | 3/2006 |
| CA | 2526724 | | 5/2006 |
| EM | 001048508 | | 4/2009 |
| WO | 94/21334 | A1 | 9/1994 |
| WO | 01/14019 | A1 | 3/2001 |
| WO | 20061016911 | A1 | 2/2006 |
| WO | 20071033536 | A1 | 3/2007 |

OTHER PUBLICATIONS

Title: STX Womens AL6000 Lacrosse Shaft, printed from http://www.dickssportinggoods.com/sm-stx-womens-al6000-lacrosse-shaft-pi-2129845.html.
Title: Choosing a Lacrosse Stick printed from http://www.longstreth.com/Pages./Lacrosse_Stick_Selection.html.
Patent abstract from JP 09-000664.
Patent abstract from JP 10-165544.
Patent abstract from JP 2007-209753.
Canadian Industrial Design Application No. 128801, filed on Nov. 28, 2008, Title: Hockey Stick Shaft (application as filed enclosed).
Canadian Industrial Design Application No. 128803, filed on Nov. 28, 2008, Title: Elements of a Hockey Stick Shaft (application as filed enclosed).
Canadian Industrial Design Application No. 128802, filed on Nov. 28, 2008, Title: Portion of a Hockey Stick Shaft (application as filed enclosed).
Russian Design Application No. 2008504306, filed on Dec. 1, 2008, Title: Hockey Stick (application as filed enclosed).
Chinese Design Application No. 200830273092.6, filed Dec. 1, 2008, Title: Hockey Stick (application as filed enclosed).
Chinese Design Application No. 200830273091.1, filed on Dec. 1, 2008, Title: Hockey Stick Shaft (application as filed enclosed).

* cited by examiner

ICE HOCKEY STICK

FIELD OF THE INVENTION

The present invention relates to ice hockey sticks.

BACKGROUND OF THE INVENTION

Ice hockey is a high paced, physically demanding sport that requires high levels of skill and endurance from the players. To stay on top of their game, ice hockey players are in need of reliable high performance equipment that enhances their game skills. One key piece of equipment used by players is the ice hockey stick. It is the stick that is used to hit the puck to move it around the rink during game play. Goals are scored in the game by hitting the puck into the opposing team's net.

There are several different kinds of shots that a player can take with his stick to move the puck around the rink. One important shot type is the "slap shot". This shot is typically used in situations where great puck speed is required. In the slap shot, the player carries out a shot motion that causes his stick blade to hit the ice before it hits the puck. In most instances, when a player hits a slap shot, it is because he has decided that a shot having high puck speed would be beneficial under the circumstances. This may be the case for instance if the player is shooting on the net. The faster the puck travels toward the net, the less time the goalie will have to react to the shot and to prevent the puck from entering the net and a goal being scored. Depending on his position and a variety of other factors, a player may decide that a slap shot presents the best opportunity for him to score a goal.

The top puck speed (otherwise known as maximum shot speed of the stick) that may be generated by a slap shot (by a particular player) in any given instance will vary depending on a number of factors. The stick itself is an important factor. All other things being equal, the amount of additional energy that may be stored in a stick and imparted to the puck will determine the top puck speed generated by a slap shot using that stick.

While the literature (patent and otherwise) describes many different types of ice hockey sticks, and while there have certainly been improvements in ice hockey stick technology, the vast majority of sticks actually used over the past 125 years of playing the sport are very similar in size and shape to each other and to those in use today.

In this respect, today's conventional hockey sticks have a shaft and an adjoining blade. The shaft has a handle (being the portion that a typical player grasps during most of the course of normal use of the stick during game play) and a shank (being the portion extending below the handle to the connection point with the neck of the blade). The handle is generally rectangular usually with chamfered, bevelled or rounded corners (as the case may be—depending usually on the material of which the shaft is made and the method of its construction). The longer sides of the rectangle are those which form part of the front and rear faces of the shaft (the front face of the shaft being that face which faces in generally the same direction as the striking surface of the blade; the rear face being the face opposite the front face). The shank is also generally rectangular, however, its corners are not usually chamfered, bevelled nor rounded; or if they are, only slightly so. The shank tapers in width (between the front face and rear face) from the handle down the shaft towards the point to which the blade is attached. The shank does not usually taper in width between the left face and the right face of the shaft (the faces formed by the shorter two sides of the rectangle). The blade has a body having a striking surface and a neck extending upwards from the body that connects to the shank of the shaft.

Unlike their general size and shape, the materials of construction of ice hockey sticks have changed over the course of time. At various times ice hockey sticks have been made having shafts of solid wood, laminated wood, fibreglass-reinforced-polymer-coated wood, fibreglass-reinforced polymers, aluminium, titanium, and carbon-fibre-reinforced polymers. Similarly, at various times hockey stick blades have been commonly made of different materials including wood and carbon-fibre-reinforced polymers. Current conventional sticks are one piece sticks having both a shaft and a blade made of a carbon-fibre-reinforced polymer, the shaft typically being hollow.

As the materials of construction of sticks have changed, ice hockey stick design engineers have learned to manipulate various stick characteristics to improve the maximum shot speed of the stick. However, in recent years, the maximum shot speed of ice hockey sticks has plateaued, but hockey sticks having increased maximum shot speeds over what is currently available are desired in the marketplace.

SUMMARY OF THE INVENTION

It is therefore an object of the present invention to provide for an improved ice hockey stick compared with those of conventional designs, and particularly one having a generally improved maximum shot speed over at least some of those of conventional designs.

Thus, in one aspect, as embodied and broadly described herein, the present invention provides an ice hockey stick comprising a shaft and an adjoining blade. The shaft has a proximal end proximate the blade, a distal end opposite the proximal end, an outer surface having a generally rectangular cross-sectional shape transitioning towards the proximal end to one of a generally hexagonal, octagonal, decagonal, or dodecagonal cross-sectional shape, and a front shaft face and an opposing rear shaft face. A width of a portion of the shaft, as measured between the front shaft face and the rear shaft face, tapers towards the proximal end. The blade has a front blade face being flush with the front shaft face, a rear blade face, opposing the front blade face. The rear blade face is flush with the rear shaft face. The blade has a heel and a neck affixed to the proximal end of the shaft.

The present inventors have discovered that changing the cross-sectional shape of the outer surface of the shaft of an ice hockey stick in certain portions while maintaining a conventional shape in other portions, yields, at least in some cases, an ice hockey stick having an improved shot speed over a similar stick having a conventional shape over the entirety of its outer surface. Particularly, the present inventors have discovered that if the portion of the shaft near the distal end has a conventionally-shaped outer surface as described above (i.e. is generally rectangular preferably with chamfered, bevelled or rounded corners) while a portion of the shaft closer to the proximal end of the shaft has a generally hexagonal, octagonal, decagonal, or dodecagonal shaped outer surface, an improved shot speed (as compared with a similar stick having the conventional shape over the entirety of its outer surface) will likely result.

Without wishing to being bound by any particular theory, it appears that increasing the number of sides of the shape of the outer surface as described above yields a structure that is able to store more potential energy and convert that energy to kinetic energy during a slap shot than is a stick having a conventional outer surface shape.

Of the generally hexagonal, octagonal, decagonal, or dodecagonal shaped outer surface, a generally octagonal shaped outer surface is preferred. A generally octagonal shaped outer surface will have four pairs of opposing sides including a front side forming part of the front shaft face and a rear side forming part of the rear shaft face. It is preferred that the distances between each of the other three pairs of the opposing sides exceed the distance between the front side and the rear side by a range of about 40% to about 200%. It is more preferred that the distances between each of the other three pairs of the opposing sides exceed the distance between the front side and the rear side by a range of about 50% to about 175%. It is still more preferred that the distances between each of the other three pairs of the opposing sides exceed the distance between the front side and the rear side by a range of about 50% to about 150%.

It should be noted that while it has been suggested in the prior art to make "hockey sticks" in general (although not ice hockey sticks in particular) having a shaft having an outer surface that is octagonal in cross-sectional shape along its entire length (e.g. United States Patent Application Publication No. 2007/0010358 to Filice et. al; Canadian Patent Application No. 2,506,213 to Tsai), neither those applications nor any other prior art known to the inventors describe nor suggest that shaft having a conventional generally rectangular portion of the handle and a portion near the proximal end being one of a hexagonal, octagonal, decagonal, or dodecagonal cross-sectional shape that can store and convert additional potential energy over a shaft having a conventional design. Conversely, Tsai teaches, inter alia, that having a shaft having an octagonal outer surface cross-section on the portions of the shaft typically grasped by the player yields a stick that a player can better control.

It should be understood that for the purposes of the present specification, a generally rectangular shape remains generally rectangular notwithstanding the presence of a chamfered or bevelled corner (or corners). For example, a generally rectangular shape is considered generally rectangular notwithstanding the presence of a chamfered or bevelled corner that itself alone reduces the length of either adjacent side by more than about 15%. (The length of a side of the generally rectangular shape being referred to here is the length that that side would have had had the chamfer/bevel in question as well as any other chamfers/bevels at any other corners not have been present.) In such cases, that chamber/bevel is not considered a side of the shape.

If there is a chamfer or bevel in any one corner that does itself alone reduce the length of an adjacent side by more than 15%, then that chamfer or bevel can be considered itself a side of the shape, thus increasing the number of sides of the shape by one, creating, for example in the case of a rectangle, a pentagon, hexagon, heptagon, or octagon (as the case may be depending on the number of chamfered/bevelled corners of the shape that meet this limitation).

Similarly, it should be understood that for the purposes of the present specification, a generally rectangular shape remains generally rectangular notwithstanding the presence of rounded corners. For example, a generally rectangular shape is considered generally rectangular notwithstanding the presence of a rounded corner between one of its major sides and one of its minor sides whose radius of curvature is less than 20% of the length of the major side (in cases of varying radii of curvature, it being the radius of curvature parallel to the major side that is being referred to), and less than 25% of the length of the minor side (in cases of varying radii of curvature, it being the radius of curvature parallel to the minor side that is being referred to), is not considered a side of the rectangle.

It is preferable that the ice hockey stick shaft define a handle and a shank; the handle being that portion of the shaft that a typical player grasps during most of the course of normal use of the stick during game play. The shank is that portion of the shaft that connects the handle to the neck of the blade (which may from time to time be grasped by the player as well depending on the circumstances and that player's style of play). It should be understood that no particular markings or structure necessarily need be present on the shaft for the shaft to "define" either the handle or the shank. The two may still be present on the stick notwithstanding the fact that there may be nothing physically present on the shaft to distinguish between them.

Where the shaft has a shank, it is preferable that at least the width of a portion of the shank taper and it is at least a portion of the outer surface of the shank that is the one of generally hexagonal, octagonal, decagonal, or dodecagonal in cross-sectional shape. Moreover, it is more preferable that the entirety of the shank be the one of generally hexagonal, octagonal, decagonal, or dodecagonal in cross-sectional shape, as this configuration is theorized to maximize the benefits provided by the invention. In addition, where there is no blade neck insert portion (as described below) it is preferred that the entirety of the shank taper in width as well. Where there is an insert portion, it is preferred that the shank taper until the start of the portion thereof that will be underlapped by the insert portion when the stick is assembled, and then remain of constant width from that point until the proximal end of the shaft.

In any case, it is preferred that the generally rectangular shape of the outer surface begin at the distal end of the shaft and transition across an intermediate portion of the shaft (not necessarily a central portion) to the one of the generally hexagonal, octagonal, decagonal, or dodecagonal cross-sectional shape towards the proximal end and remain so until the proximal end. It should be understood however that the present invention is not limited to shafts with an outer surface having only two different shapes in cross-section (i.e. a generally rectangular one and a generally hexagonal, octagonal, decagonal, or dodecagonal one). As long as those two outer surface cross-sectional shapes are present (as described above), others may be as well. Thus, there may be additional outer surface cross-sectional shapes above (i.e. more towards the distal end) the generally rectangular one and/or ones below (i.e. more towards the proximal end) the generally hexagonal, octagonal, decagonal, or dodecagonal one.

The present invention does not require that all of the corners (be they rounded, chamfered, bevelled, or otherwise) of the outer surface cross-sectional shape (whatever that shape may be) be identical to one another. Some embodiments of the invention have corners that differ from one another. Further, while all outer surface cross-sectional shapes of the present are simple polygons, there is no requirement that they be either equiangular or equilateral. Some embodiments of the invention have one (or more) outer surface cross-sectional shapes that are neither equiangular nor equilateral.

As was noted above the outer surface "transitions" from being generally rectangular in shape to one of a hexagonal, octagonal, decagonal, or dodecagonal in shape. In the context of the present specification, this should simply be understood as requiring a change from one shape to the other; no particular type or kind of change is required. Thus, while a relatively long smooth transition from one shape to the other is preferred, the present invention does not require such a transition. Short, abrupt, and/or irregular transitions are all within the scope of the present invention, although are generally less preferred.

Preferably, the transition begins at or close to the juncture of the handle and the shank of the shaft. In this manner, a typical player will, for the most part, grasp a portion of the shaft having a conventional design during game play. Thus, preferably the distance between the start of the transition and the proximal end of the shaft is less than about 40% of the total length of the shaft. More preferably this distance is between about 10% and about 40%, still more preferably it is between about 15% and about 40%, yet more preferably it is between about 20% and about 40%. Most preferably, the distance is between about 28% and about 38% as it varies depending on, amongst other things, whether the stick in question is an adult ice hockey stick or a child ice hockey stick. Where the stick is an adult ice hockey stick this distance is preferably less than about 35% to 38%. Where the stick is a child ice hockey stick this distance is preferably less than about 28% to 30%. Thus the transition point for a typical adult ice hockey stick is about 50-51 cm or less from the proximal end of the shaft, and for a typical child ice hockey stick is about 28 cm or less from the proximal end of the shaft.

In some embodiments, the shape of the outer surface of the neck of the blade is of the same shape as the outer surface of the proximal end of the shaft and continues to be of this shape (progressing toward the heel of the blade) until joining the body of the blade. In other embodiments, the shape of the outer surface of the neck will transition to another shape before joining the body of the blade. In such cases, a transition to a generally rectangular shape is preferred (but not required).

It is preferred that the neck of the blade taper from its connection point with the proximal end of the shaft to the heel of the blade. Thus, in embodiments where the shank of the shaft tapers until the proximal end, it is preferred that the taper continue (preferably uninterrupted at the same rate) through the neck of the blade to the heal of the blade. In embodiments where the shank of the shaft does not taper all the way until the end (such as in some embodiments where there the neck of the blade has an insert portion), it is nonetheless preferred that the taper resume in the neck of the blade through to the heel of the blade. This taper is theorized to improve the performance a stick of the present invention in some embodiments, and also, in this way, the outer surface of the stick itself presents a clean, continuous appearance. This taper should not be understood to be required, however. Embodiments wherein the taper continues only in part through the neck but does not continue until the heel, and those wherein the neck does not taper at all, are both within the scope of the present invention.

The generally rectangular shaft also comprises a left shaft face and an opposing right shaft face. As is the case with conventional ice hockey sticks it is preferable that the depth of the shaft, as measured between the left shaft face and the right shaft face, be generally constant throughout the entire length of the shaft. This is the case in order to allow for a typical player to maintain a good grasp on the stick such that the stick is unlikely to involuntarily rotate in his hands.

While not required, ice hockey sticks of the present invention preferably have shafts with a hollow interior. Where such is the case, for ease of manufacturing (depending on the method of manufacturing and the design of the shaft), the shaft hollow inner surface may have a cross-sectional shape that is the same as the shape of the outer surface cross-section at that point on the shaft. This however is not a requirement of the present invention, and the inner surface cross-section varies from the outer surface cross-section in some embodiments. In one means of manufacturing such a stick, the shaft and the blade are separately manufactured and later joined together to form a stick. In such cases, preferably the neck of the blade has an insert portion that is inserted inside the proximal end of the shaft and is attached thereto (e.g. the outer surface of the insert portion is glued to the hollow inner surface of the proximal end of the shaft). Thus, in embodiments where the proximal end of the shaft has an outer surface that is octagonal in cross section, the insert portion of the blade is preferably affixed to the hollow interior of the shaft at portions of each one thereof having mating generally octagonal cross-sections.

It is highly preferred that the blade insert portion (if present) have a longitudinal length (i.e. the length by which it extends into the hollow interior of the shaft) as small as possible and in any event less than about 60 mm. In some preferred embodiments, the insert length is about 35 to about 55 mm. Insert portions having a longer longitudinal length appear to negate the benefits of having the non-generally rectangular portion (as described herein) in the shaft 102. Thus in increasing order of preference are longitudinal lengths of less than about 50 mm, less than about 40 mm, and less than about 25 mm. Whatever the longitudinal length of the insert portion, it is highly preferred that there be a portion of the shaft not underlapped by the insert portion that is tapering in width and has an outer surface being the one of generally hexagonal, octagonal, decagonal, or dodecagonal in cross-sectional shape. This is an additional limitation on the length of the insert portion. In some embodiments, the insert portion of the blade is filled with foam.

Without wishing to be bound by a particular theory, the inventors believe that the flexibility of shaft (and thus the amount of potential energy it can store in the context of the present invention) in the tapering portion having an outer surface cross-sectional shape being the one of generally hexagonal, octagonal, decagonal, or dodecagonal is negatively affected by the presence of an underlapping insert portion. Hence, the high preference for such a portion not being underlapped.

In view of the above, it is more highly preferred that neck of the blade be attached to the shank of the shaft by direct end-to-end connection with no insert portion at all (i.e. the neck of the blade has an end that is connected to the proximate end of the shaft, there being no portion of the neck inserted inside the proximate end of the shaft). This is will avoid any negative effects of having an insert portion inserted in the proximate end of the shaft. It is even more highly preferred that the shaft and the blade be unitarily formed, thus there will be no need to join them together at some later point in the manufacturing process. This will eliminate any negative effects of having a joint altogether.

It is preferred that the shaft and the blade are formed of the same material, and that that material includes a carbon-fibre reinforced polymer. Examples of suitable fibres can include, but are not limited to, carbon fibre, glass fibre, amide fibre, and combinations thereof. Suitable polymer matrices can include, but are not limited to, epoxy, vinyl, ester, acrylic, and thermoplastic based polymers.

Finally, it should be noted that embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF PREFERRED EMBODIMENTS

Introduction

Figure 1:
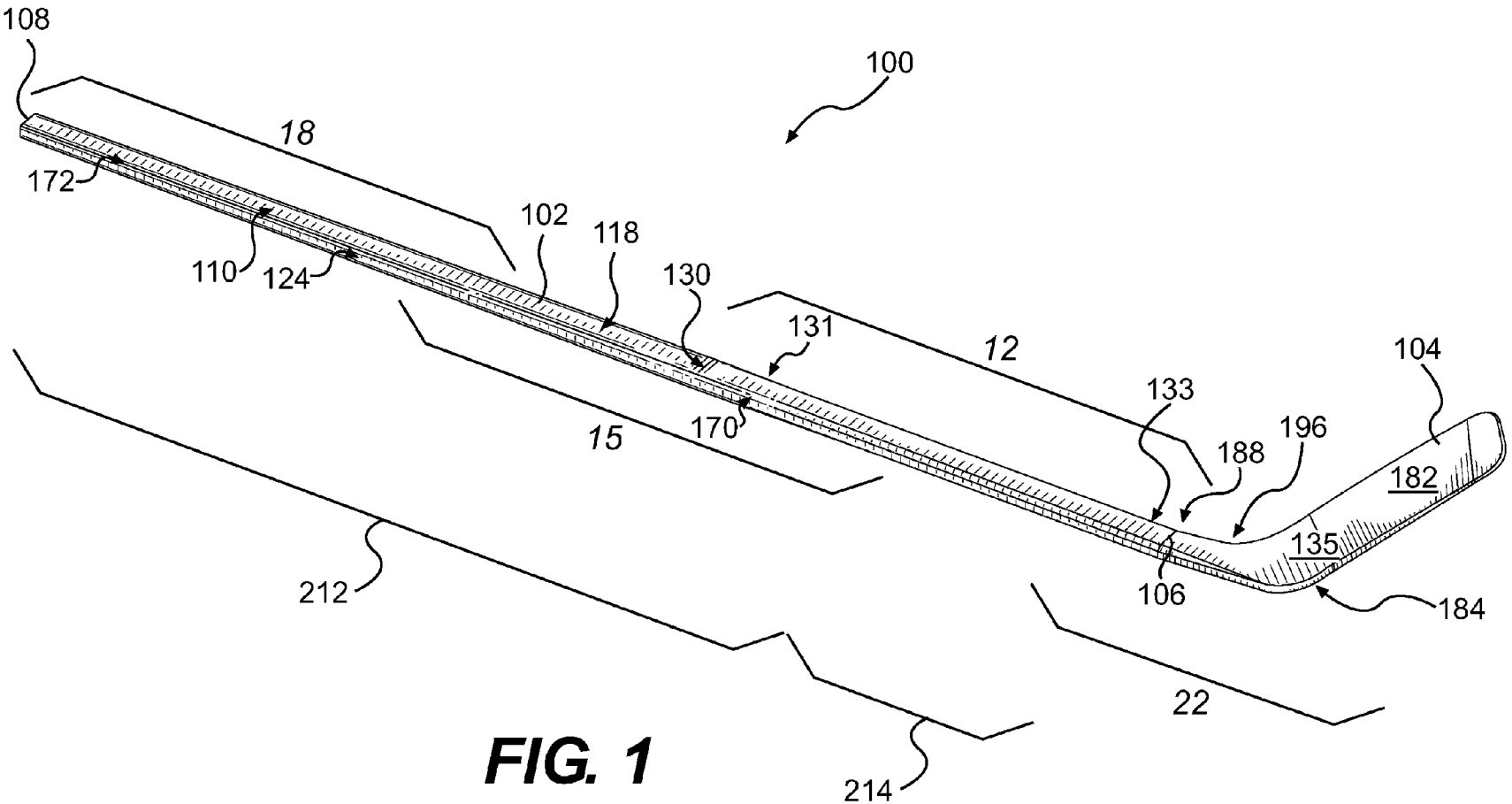
FIG. 1 is a rear left perspective view of an ice hockey stick being an embodiment of the present invention.

Referring to FIG. 1, there is shown an ice hockey stick 100 being an embodiment of the present invention. It is to be expressly understood that ice hockey stick 100 is merely a preferred embodiment of the invention. The description thereof that follows is intended to be only a description of a physical example of the invention. This description is not intended to define the scope or set forth the bounds of the invention. In some cases, what are believed to be helpful examples of modifications to the ice hockey stick 100 are also set forth hereinbelow. This is done merely as an aid to understanding, and, again, not to define the scope or set forth the bounds of the invention. These modifications are not exhaustive list, and, as a person skilled in the art would understand, other modifications are likely possible. Further, it should not be interpreted that where this has not been done, i.e. where no examples of modifications have been set forth, that no modifications are possible and/or that what is described is the sole physical means of embodying that element of the invention. As a person skilled in the art would understand, this is likely not the case.

Ice hockey stick 100 has a shaft 102 and an adjoining blade 104. Stick 100 is a right-handed stick. An example of a left-handed stick being an embodiment of the present invention would be (but is not limited to) a mirror image of stick 100.

Shaft—Description of Outer Surface Shape

The shaft 102 has a proximal end 106 proximate the blade 104 and to which the blade 104 is affixed. The shaft 102 also has a distal end 108 opposite the proximal end 106 and an outer surface 110. The outer surface 110 of the shaft 102 has a generally rectangular shape at the distal end 108 that transitions to a generally octagonal shape at the proximal end 106.

Figure 5:
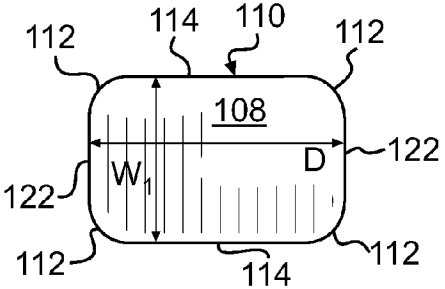
FIG. 5 is a top plan view of the shaft of the ice hockey stick of FIG. 1 shown apart from the blade of the ice hockey stick of FIG. 1 for ease of understanding.

Specifically, in this embodiment, the distal end 108 is generally rectangular in outer surface 110 cross-sectional shape, as may be best seen in FIG. 5. Thus, the outer surface 110 of the distal end 108 has two major (i.e. the longer) generally straight identical parallel sides 114, two minor (i.e. the sides perpendicular to the major sides) generally straight identical parallel sides 122, and four identical rounded corners 112 connecting the major sides 114 with the minor sides 122.

Figure 6:
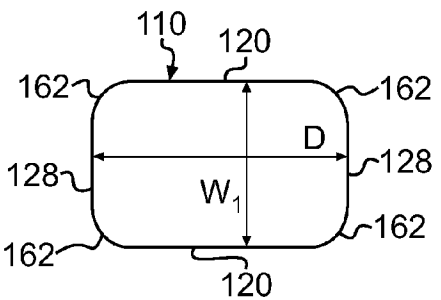
FIG. 6 is a cross-sectional view of the outer surface of the shaft of the ice hockey stick of FIG. 1 taken along the line 6-6 in FIG. 2.
Figure 18:
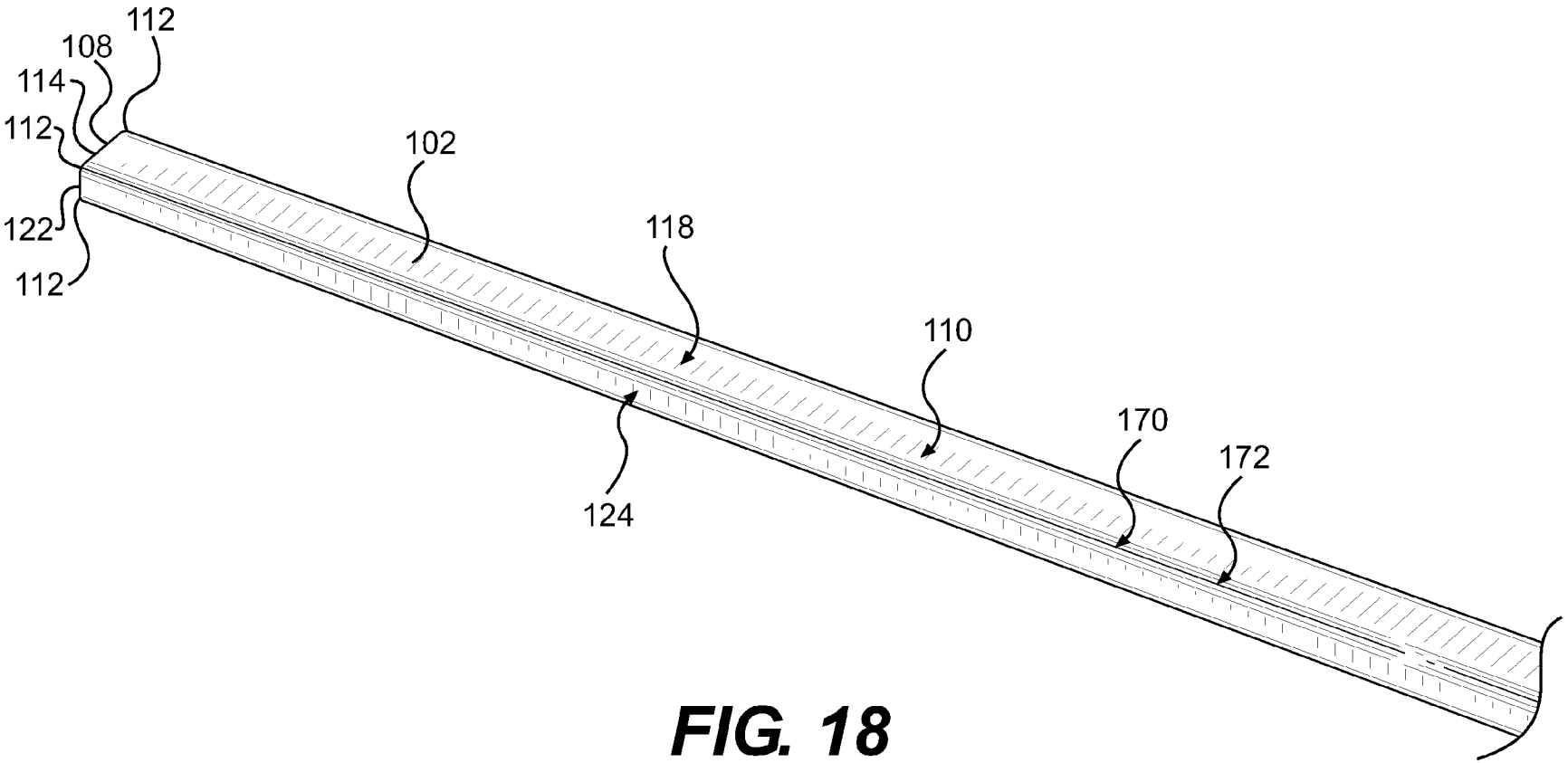
FIG. 18 is a rear left perspective close-up view of the portion indicated by bracket 18 of the shaft of the ice hockey stick of FIG. 1.
Figure 19:
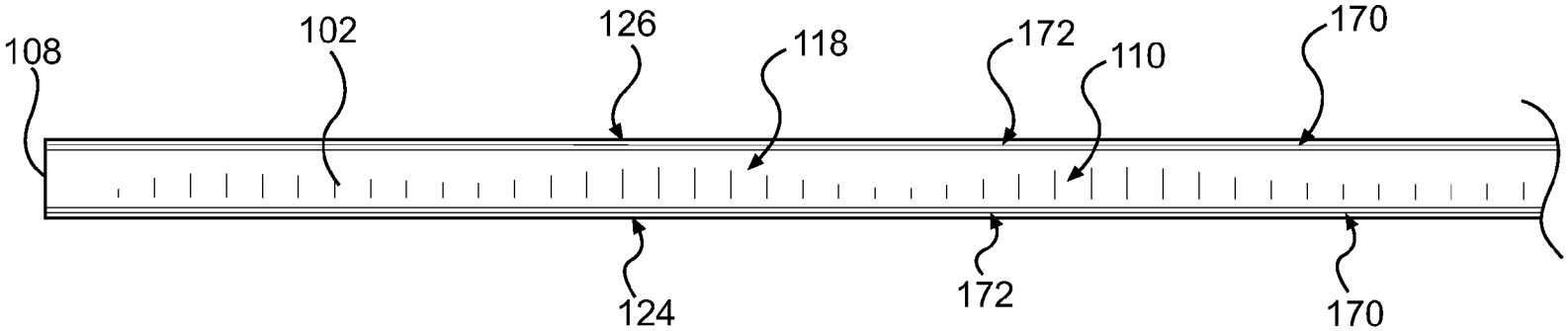
FIG. 19 is a rear elevation view of the portion of the shaft of the ice hockey stick shown in FIG. 18, a front elevation view being a mirror image thereof.
Figure 20:
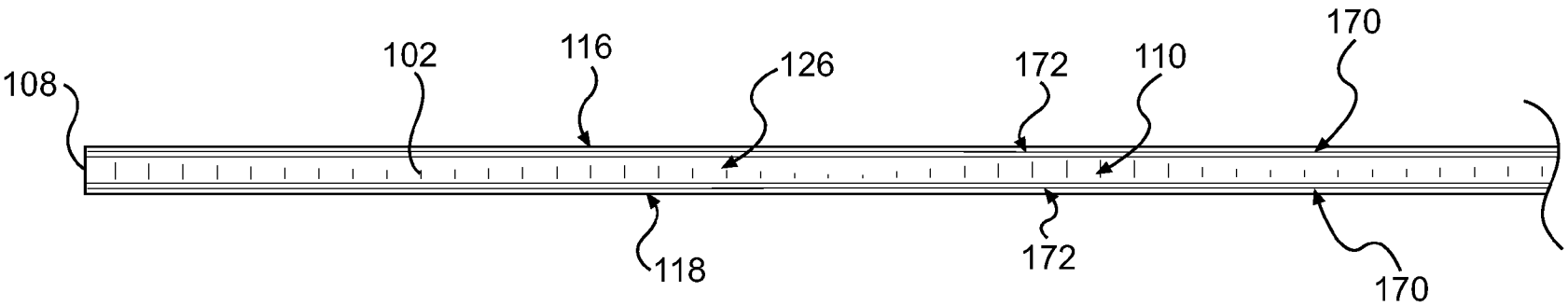
FIG. 20 is a right side elevation view of the portion of the shaft of the ice hockey stick shown in FIG. 18, a left side elevation view being a mirror image thereof.
Figure 21:
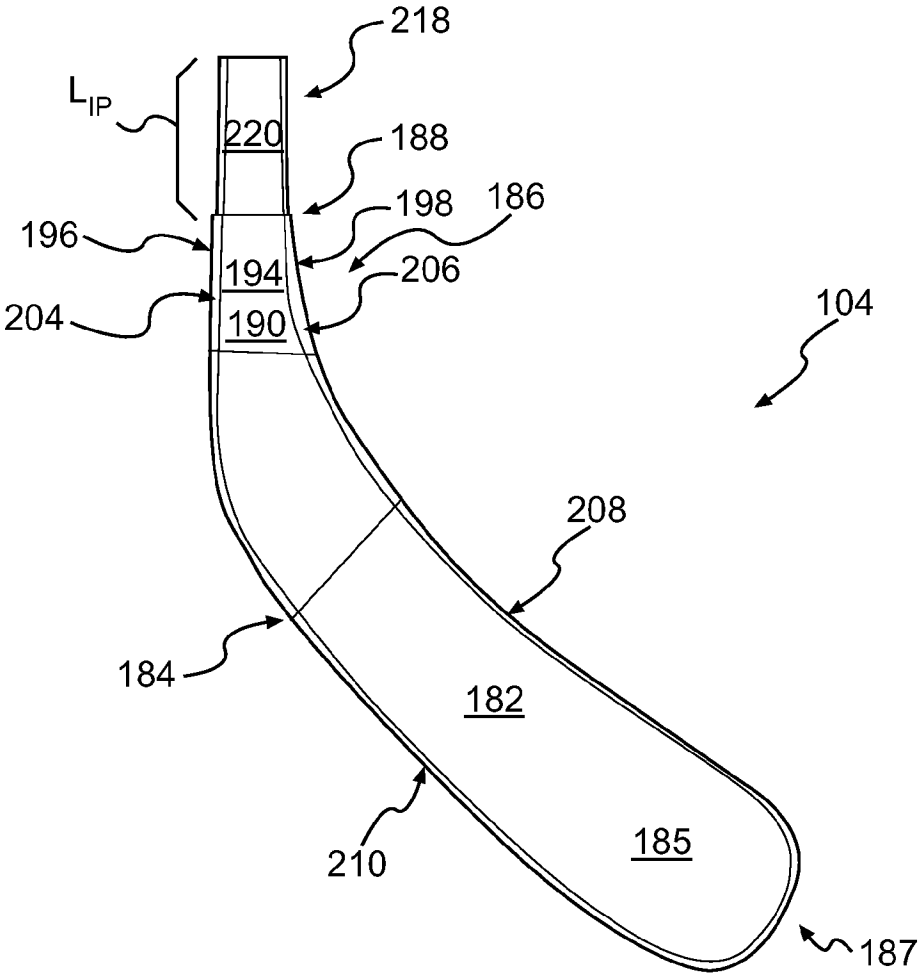
FIG. 21 is a rear elevation view of the blade of the ice hockey stick of FIG. 1 shown apart from the shaft of the ice hockey stick of FIG. 1 for ease of understanding.

The shape of the outer surface 110 remains constant for a portion of the longitudinal length of the shaft 102 extending from the distal end 108 towards the proximal end 106 in this embodiment. Thus, referring to the perspective fragmentary view shown in FIG. 18 (indicated by bracket 18 in FIG. 1) and the front and side elevation views thereof (shown in FIGS. 19 and 20 respectively), it can be seen that the shape of the outer surface 110 remains constantly generally rectangular. In this respect, see FIG. 6, which is a cross-section of the shape of outer surface 110 (i.e. the outer surface only—this view should not be taken to mean that the shaft is solid) of the shaft 102 taken along a line 6-6 shown in FIG. 2. This outer surface 110 cross-sectional shape is also generally rectangular, being of the same shape and size as the distal end 108 of the shaft 102. Thus, major sides 120 of the outer surface 110 cross-sectional shape shown in FIG. 6 are identical to major sides 114 of the distal end 108 shown in FIG. 5. Similarly, again referring to FIG. 6, minor sides 128 of the outer surface 110 cross-section shown therein are identical to the minor sides 122 shown in FIG. 5. Finally, again referring to FIG. 6, rounded corners 162 of the outer surface 110 cross-section shown therein are identical to rounded corners 112 shown in FIG. 5. Indeed, all outer surface 110 cross-sectional shapes taken along the longitudinal length of the shaft 102 between the distal end 108 and the line 6-6 shown in FIG. 2 are identical in this embodiment.

Progressing down the longitudinal length of the shaft 102 away from the distal end 108 past cross-section 6-6 towards the proximal end, the cross-sectional shape of the outer surface 110 remains generally rectangular, however no longer constant as the shaft 102 has begun to taper (discussed in further detail hereinbelow). In this respect, see FIG. 7, which is a cross-section of the shape of outer surface 110 of the shaft 102 taken along a line 7-7 shown in FIG. 2. The outer surface 110 cross-sectional shape is generally rectangular, with the major sides 132 being identical to major sides 120 of FIG. 6 and major sides 114 of FIG. 5. However minor sides 134 are shorter in length than minor sides 128 of FIG. 6 and 122 of FIG. 5 (but are generally straight, identical and parallel to each other). Rounded corners 164 (identical to each other) are similar to rounded corners 162 of FIG. 6 and 112 of FIG. 5.

Figure 16:
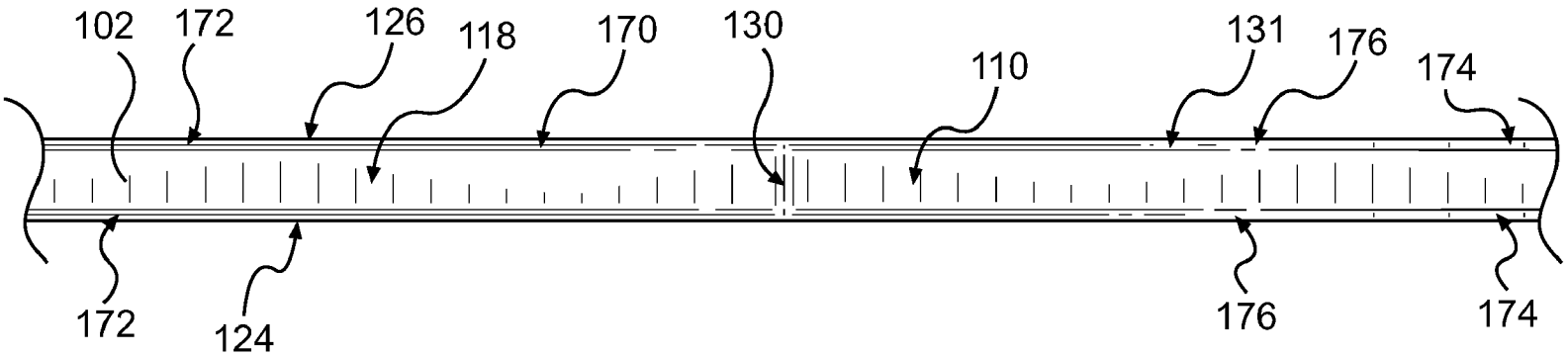
FIG. 16 is a rear elevation view of the portion of the shaft of the ice hockey stick shown in FIG. 15, a front elevation view being a mirror image thereof.
Figure 17:
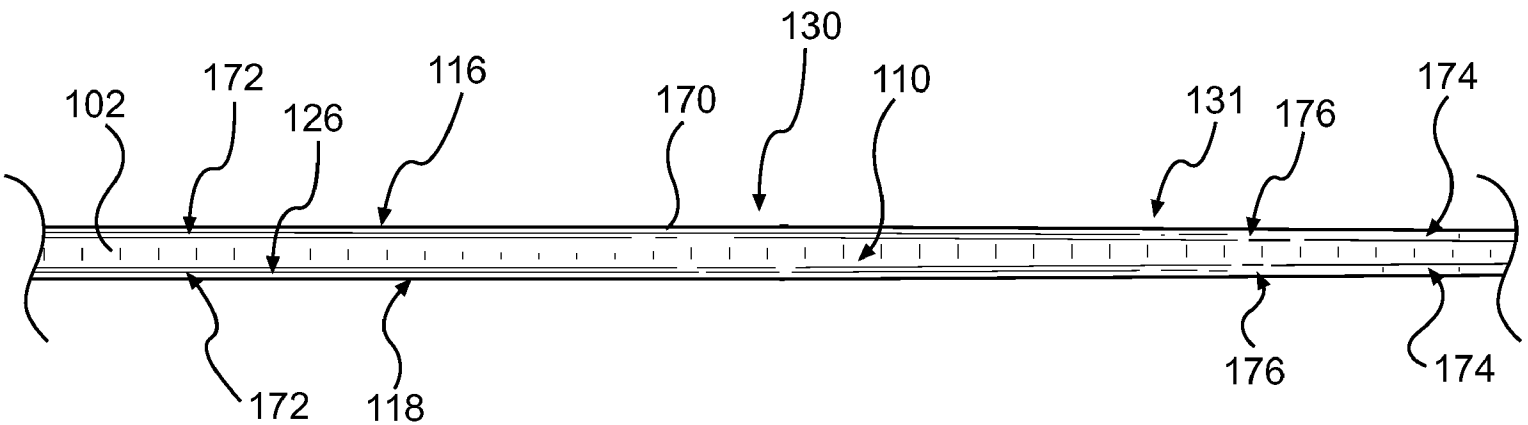
FIG. 17 is a right side elevation view of the portion of the shaft of the ice hockey stick shown in FIG. 15, a left side elevation view being a mirror image thereof.

Progressing further down the longitudinal length of the shaft 102 away from distal end 108 past cross-section 7-7 towards proximal end 106, at a certain point 131 (in this embodiment further towards the proximal end 106 than taper point 130 (discussed hereinbelow)) the shape of the cross-section of outer surface 110 of the shaft 102 begins to transition from being generally rectangular to being generally octagonal. This transition is generally illustrated in perspective fragmentary view shown in FIG. 15 (indicated by bracket 15 in FIG. 1) and the front and side elevation views thereof (shown in FIGS. 16 and 17 respectively).

Figure 2:
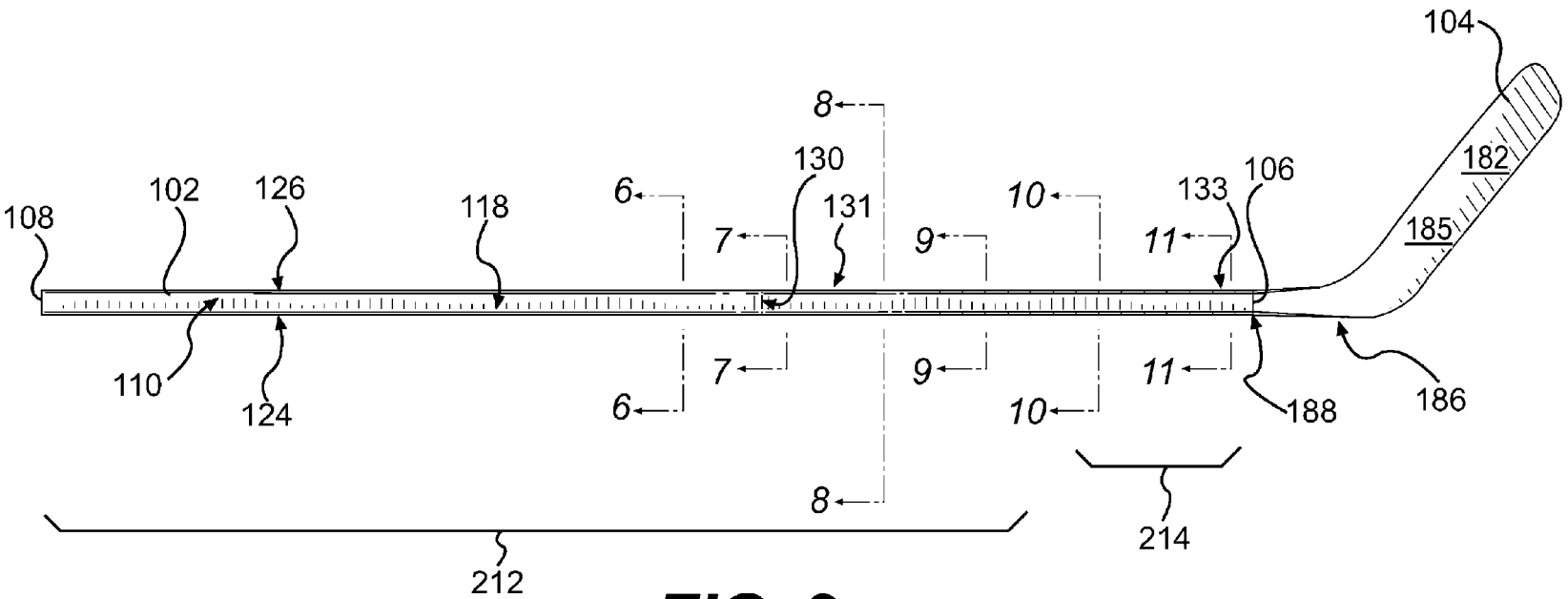
FIG. 2 is a rear elevation view of the ice hockey stick of FIG. 1, a front elevation view of the shaft of the hockey stick being a mirror image of the shaft shown in FIG. 2.
Figure 3:
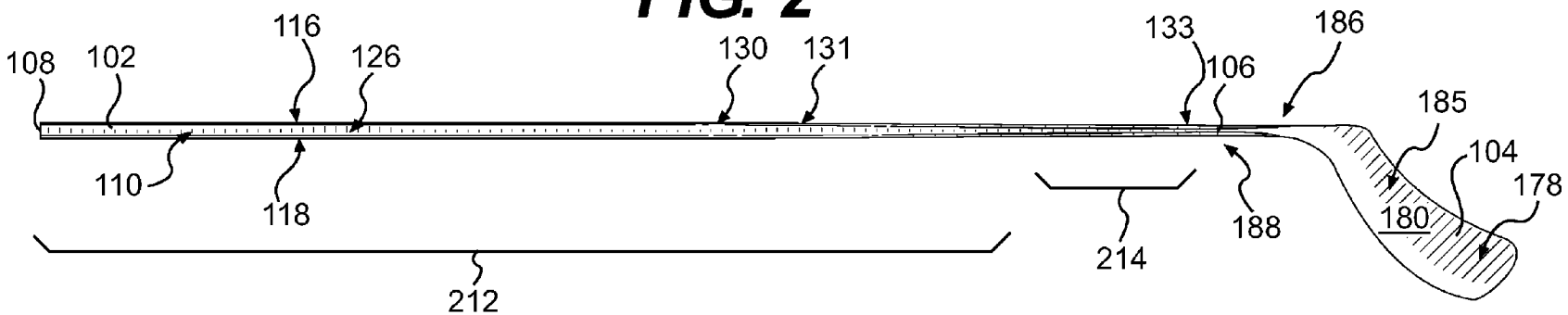
FIG. 3 is a right side elevation view of the ice hockey stick of FIG. 1, a left side elevation view of the shaft of the ice hockey stick being a mirror image of the shaft shown in FIG. 3.
Figure 8:
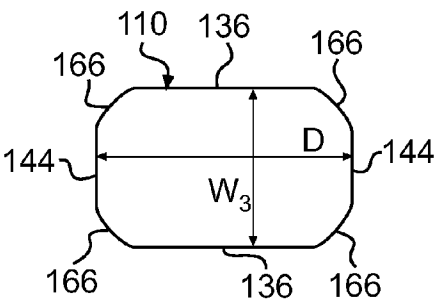
FIG. 8 is a cross-sectional view of the shaft of the outer surface of the ice hockey stick of FIG. 1 taken along the line 8-8 in FIG. 2.
Figure 9:
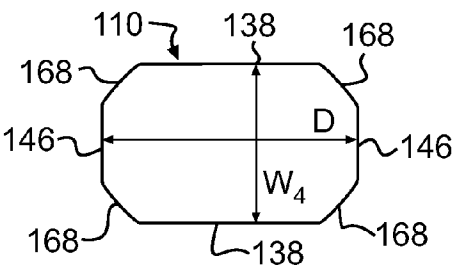
FIG. 9 is a cross-sectional view of the shaft of the outer surface of the ice hockey stick of FIG. 1 taken along the line 9-9 in FIG. 2.

In this respect, see FIGS. 8 and 9, which are cross-sections of the shape of the outer surface 110 of the shaft 102 taken along the lines 8-8 and 9-9 (respectively) shown in FIG. 2. In FIG. 8, the outer surface 110 cross-section shape is still generally rectangular, having two identical parallel major sides 136 and two identical parallel minor sides 144. However, the corners 166 are no longer rounded. Corners 166 are each formed of a curve and two distinct (although blunt) edges (shown although not separately identified); they are identical to each other. In FIG. 9, the outer surface is no longer generally rectangular, as the "corners"168 are each formed of a curve and two distinct edges (shown although not separately identified), with the curve being almost straight. Thus, in FIG. 9 the cross-sectional shape of the outer surface is generally octagonal, there being major identical parallel sides 138, minor identical parallel sides 146 and "corners" 168 forming additional diagonal identical parallel sides of the octagon connecting the major sides 138 with the minor sides 146.

Figure 10:
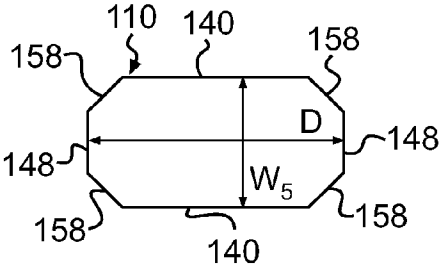
FIG. 10 is a cross-sectional view of the shaft of the outer surface of the ice hockey stick of FIG. 1 taken along the line 10-10 in FIG. 2.
Figure 12:
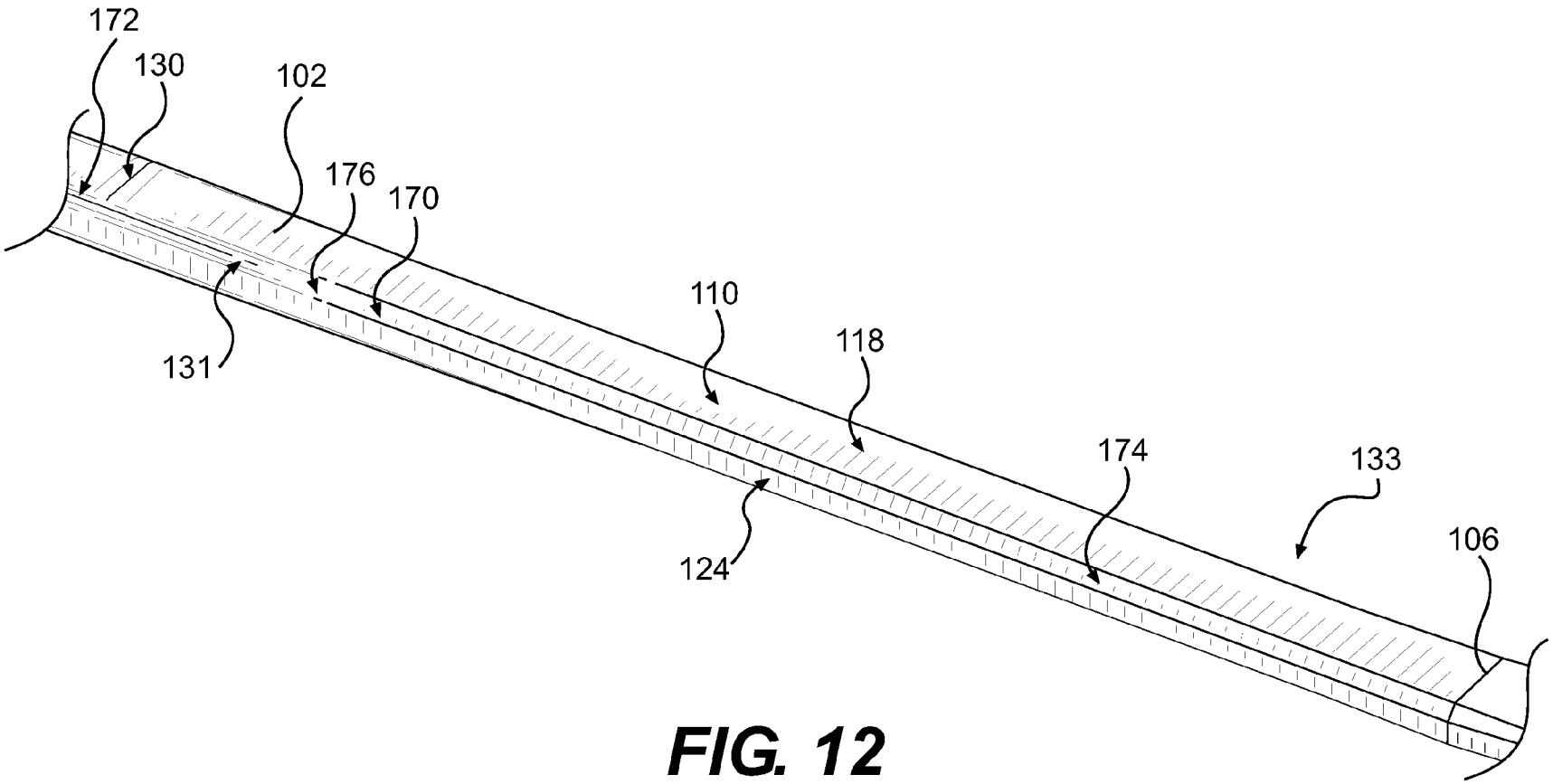
FIG. 12 is a rear left perspective close-up view of the portion indicated by bracket 12 of the shaft of the ice hockey stick of FIG. 1.
Figure 13:
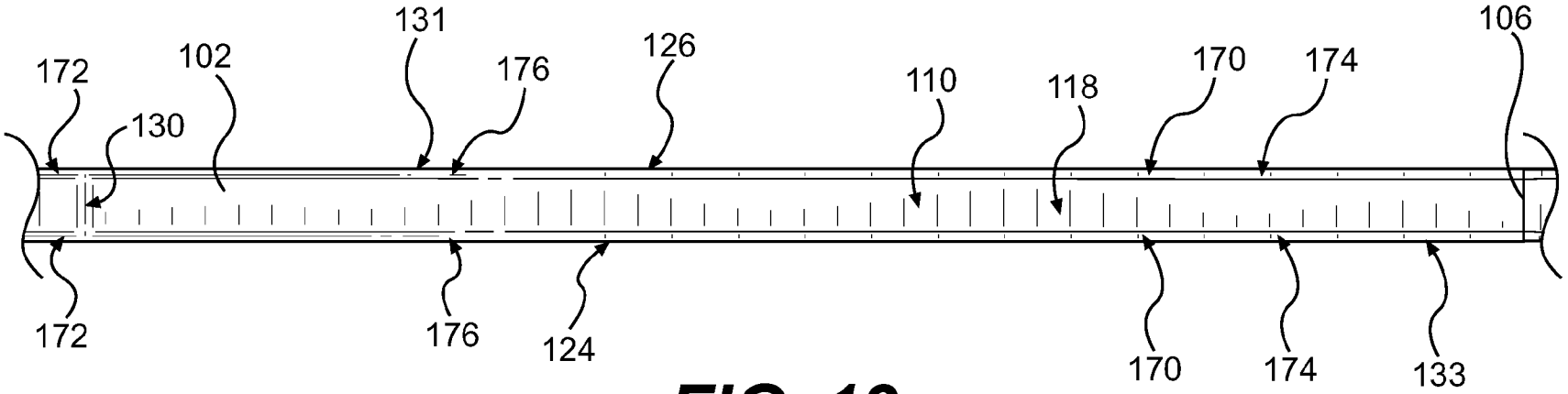
FIG. 13 is a rear elevation view of the portion of the shaft of ice hockey stick shown in FIG. 12, a front elevation view being a mirror image thereof.

Progressing still further down the longitudinal length of the shaft 102 past cross-section 9-9 towards the proximal end 106, the transition referred to above has been completed and the outer surface 110 cross-sectional shape is generally octagonal. This is illustrated in perspective fragmentary view shown in FIG. 12 (indicated by bracket 12 in FIG. 1) and the front and side elevations views thereof (shown in FIGS. 13 and 14 respectively). In this respect, see FIGS. 10 and 11, which are cross-sections of the shape of the outer surface 110 of the shaft 102 taken along the lines 10-10 and 11-11 (respectively) shown in FIG. 2. In both Figures the outer surface 110 cross-sectional shape is generally octagonal. In FIG. 10, the octagonal shape has two major generally straight identical parallel sides 140, two minor generally straight identical parallel sides 148, and 2 pairs of diagonal generally straight identical parallel (as between members of the same pair) sides 158. Similarly in FIG. 11, the octagonal shape has two major generally straight identical parallel sides 142, two minor generally straight parallel identical sides 150, and 2 pairs of diagonal generally straight identical parallel (as between members of the same pair) sides 160.

Figure 4:
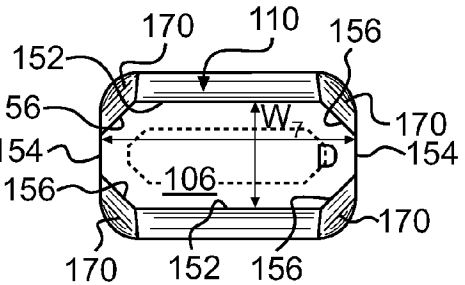
FIG. 4 is a bottom plan view of the shaft of the ice hockey stick of FIG. 1 shown apart from the blade of the ice hockey stick of FIG. 1 for ease of understanding.

Finally, referring to FIG. 4, proximal end 106 of shaft 102 is generally octagonal in outer surface 110 cross-sectional shape in this embodiment. The octagonal shape has two major generally straight identical parallel sides 152, two minor generally straight parallel identical sides 154, and 2 pairs of diagonal generally straight identical parallel (as between members of the same pair) sides 156.

Where the cross-sectional shape of the outer surface 110 is generally octagonal in this embodiment the distance between each of the three pairs of opposing sides other than the major sides 152, 138, 140, 142 (i.e. the distance between the minor sides 154, 146, 148, 150 and the distances between each of the pairs of parallel diagonal sides 156, 168, 158, 160) exceeds the distance between the front side and a rear side by a range of 50% to 150%. The table below illustrates this relationship for the octagonal shapes shown in FIGS. 9, 10, and 11.

| FIG. | DISTANCE BETWEEN SIDES | % GREATER THAN DISTANCE BETWEEN FRONT/REAR SIDES |
|---|---|---|
| 9 | Left/Right | 63% |
| | Opposite Diagonal | 54% |
| 10 | Left/Right | 100% |
| | Opposite Diagonal | 72% |
| 11 | Left/Right | 150% |
| | Opposite Diagonal | 100% |

Looking at the stick as a whole, referring to FIGS. 1 through 3 and 12 through 20, the outer surface of the shaft 102 has a front face 116, a rear face 118, a left face 124 and a right face 126. The front face 116 is the face of the outer surface 110 that faces generally in the same direction as the front face 178 of the blade 104 (described hereinbelow). The rear face 118 is the face opposite the front face 116. The left face 124 and the right face 126 are defined consistent with the front face 116 and the rear face 118.

The front face 116 and rear face 118 of the outer surface 110 of the shaft 102 are each formed from one of the major sides of the polygons of the various cross-sectional shapes, e.g. major sides 114, 120, 132, 136, 138, 140, 142, 152. The front face 116 and rear face 118 are thus each generally planar and generally rectangular in shape in this embodiment. The left face 124 and the right face 126 of the outer surface 110 of the shaft 102 are each formed from one of the minor sides of the polygons of the various cross-sectional shapes, e.g. minor sides 122, 128, 134, 144, 146, 148, 150, 154. Owing to the taper described hereinbelow, the left face and the right face are loosely isosceles trapezoidal in shape in this embodiment with the long base being at the distal end 108 of the shaft 102 and the short base being at the proximal end 106 of the shaft 102.

The shaft 102 has four structures 170 that join each of the four faces 116, 118, 124, and 126 together. Towards the distal end 108 the structures are each rounded curves 172 that are each formed from one of the various rounded corners 112, 162, 164 of the various rectangular shapes of the outer surface 110 cross-sections. Towards the proximal end 106 the structures are each generally planar diagonal faces 174 that are each formed from the one of the various diagonal sides 156, 158, 160 of the various octagonal shapes of the outer surface cross-sections. Intermediate the rounded curves 172 and the diagonal faces 174, as the shaft 102 transitions from being generally rectangular to generally octagonal, there is a transitional section 176 in which the rounded curves 172 begin to flatten, and smoothly and relatively gradually (in this embodiment) change (in the direction of proximal end 106) and become increasingly less rounded and more flattened. This change is apparent in the outer surface cross-sections illustrated in FIGS. 8 and 9, wherein (as previously described hereinabove) rounded corners 166 and diagonal sides 168 are neither perfectly round nor perfectly straight, rather being somewhere in between.

Shaft—Taper

Figure 14:
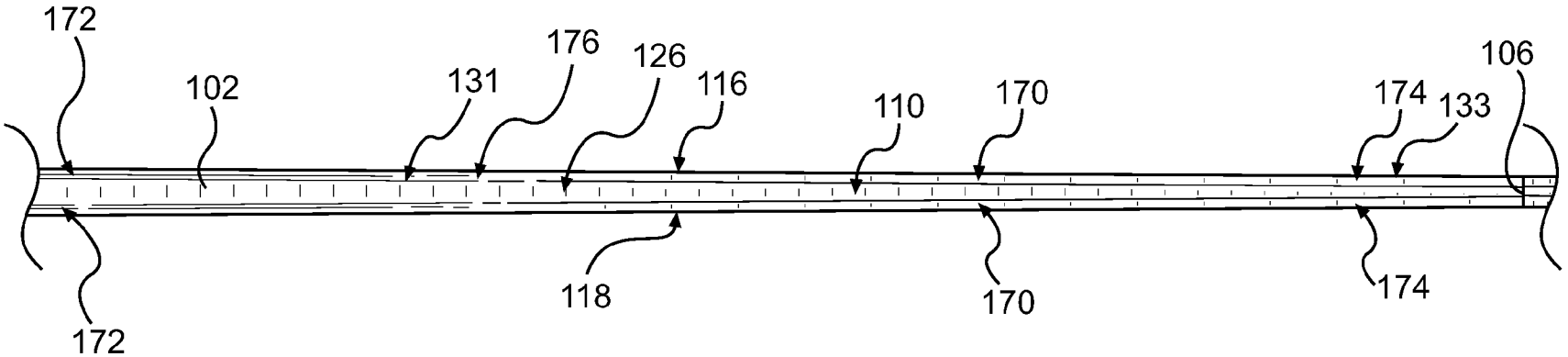
FIG. 14 is a right side elevation view of the portion of the shaft of the ice hockey stick shown in FIG. 12, a left side elevation view being a mirror image thereof.
Figure 15:
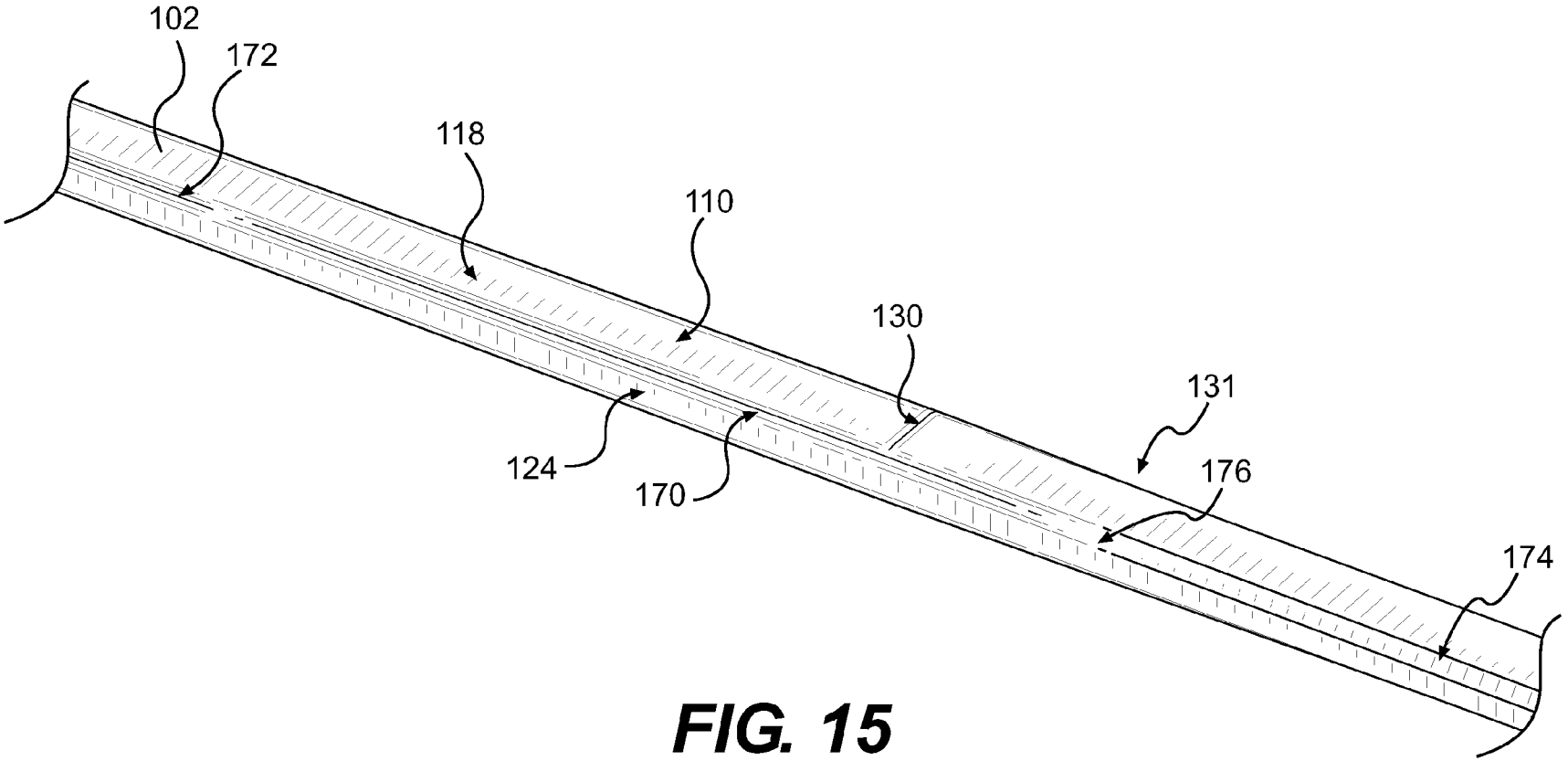
FIG. 15 is a rear left perspective close-up view of the portion indicated by bracket 15 of the shaft of the ice hockey stick of FIG. 1.

As can be seen in FIGS. 1 and 14, 15, at a certain point 130 (which is shown as a line for convenience in the Figures—although in this embodiment and indeed in most embodiments of the invention no line so distinctive will be present) the shaft 102 of stick 100 begins to taper. Specifically at taper point 130, the distance between the front face 116 and the rear face 118 (i.e. a width of the shaft as measured between the faces 116, 118) begins to gradually progressively (in this embodiment) decrease towards the proximal end 106 of the shaft.

Figure 7:
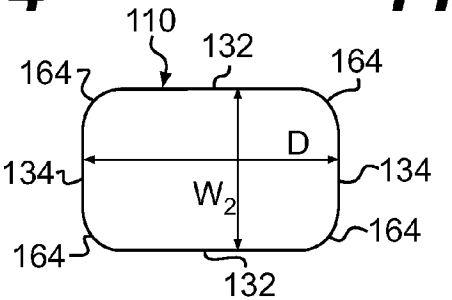
FIG. 7 is a cross-sectional view of the shaft of the outer surface of the ice hockey stick of FIG. 1 taken along the line 7-7 in FIG. 2.

This gradual progressive tapering can be seen in a comparison of FIGS. 4 through 11. In FIG. 6 the distance $W_1$ between major sides 114 (i.e. the width of the shaft 102 of the stick 100 at that point between front face 116 and rear face 118) is the same as the distance $W_1$ between major sides 114 in FIG. 5 at the distal end 108. Indeed, all cross-sections taken between the distal end 108 and that in FIG. 5 would have an identical distance between their major sides as the width of the shaft 102 is constant between distal end 108 and taper point 130. However, the cross-section shown in FIG. 7 is taken at a point closer to the proximal end 106 than taper point 130 and thus the shaft 102 has begun to taper at that point. In this respect, the distance $W_2$ taken between major sides 132 is smaller than the distance $W_1$ in FIG. 6. The shaft 102 continues to taper towards the proximal end 106 and thus distance $W_3$ (FIG. 8) is less than distance $W_2$ (FIG. 7), distance $W_4$ (FIG. 9) is less than distance $W_3$ (FIG. 8), distance $W_5$ (FIG. 10) is less than distance $W_4$ (FIG. 9), and distance $W_6$ (FIG. 11) is less than distance $W_5$ (FIG. 10). The progressive tapering is also well illustrated in bottom plan view of the shaft 102 shown in FIG. 4, which is not limited to being a cross-section of the outer surface 110 of the shaft 102.

Figure 11:
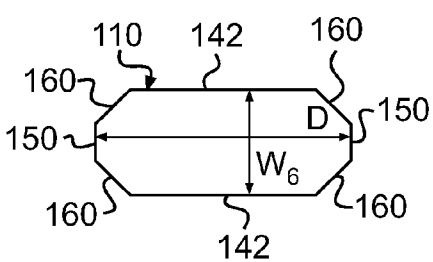
FIG. 11 is a cross-sectional view of the shaft of the outer surface of the ice hockey stick of FIG. 1 taken along the line 11-11 in FIG. 2.

The gradual progressive tapering ceases at a point 133 whose distance from the proximal end 106 is about equal to the longitudinal length ($L_{IP}$) of the insert portion 218. From that point 133 to the proximal end 106, the distance between the front face 116 and the rear face 118 of the shaft 102 remains about constant. Thus, distance $W_7$ (FIG. 4) is about equal to distance $W_6$ (FIG. 11).

The progressive decrease in the various widths (from $W_2$ to $W_6$) is accompanied in this embodiment by a progressive decrease in the length of the minor sides 122, 128, 134, 144, 146, 148, 150, 154 from the point 130 where the taper begins to the proximal end 106 of the shaft 102. It is because of the progressive decrease in the length of the minor sides 122, 128, 134, 144, 146, 148, 150, 154 that the left face 124 and the right face 126 of the shaft 102 appear to be generally isosceles trapezoidal in shape, as described above.

The progressive tapering is not, in this embodiment, accompanied by a change in the length of the diagonal sides 156, 158, 160, 168 of the various octagonal cross-sections of the shaft 102. Thus the diagonal faces 174 have a generally constant width across the longitudinal length of the shaft 102. In other embodiments, the length of the diagonal sides varies and thus the diagonal faces have a changing width across the longitudinal length of the shaft (the nature of the change depends on the nature of the variance in the length of the diagonal sides).

It should be noted that in this embodiment the point 130 at which the shaft begins to taper and the point 131 at which it begins to transition from generally rectangular to generally octagonal are not the same point. The cross-section of FIG. 7 (not having yet begun to transition to generally octagonal but having begun to taper) illustrates this point. In other embodiments, taper point and the transition point are the same point. In still other embodiments, the shaft begins to transition first and then tapers (being the reverse of the present embodiment).

Further, in this embodiment, the shaft 102 of the stick 100 does not taper in the other direction, i.e. the distance between left face 124 and right face 126 is constant throughout the longitudinal length of the shaft 102. Thus, as can be seen in FIGS. 4 through 11, the distance D between the minor sides 154, 122, 128, 134, 144, 146, 148, 150 (respectively) is the same in all of the Figures. In other embodiments, this is not the case.

Shaft—Other

As would be understood by those skilled in the art and by those who play the game of ice hockey, the shaft 102 has a handle 212 and a shank 214. In the present embodiment, the taper point 130 and the transition point 131 are both located on the handle 212 of the shaft 102. Thus the entirety of the shank 214 of the shaft 102 is generally octagonal in shape. Further all of the shank 214 except for the portion underlapped by the insert portion 118 of the blade 104 (i.e. from point 131 to point 133) tapers in width. In other embodiments this is not be the case, as the tapering and/or transition to generally octagonal in shape starts on the shank.

Figure 22:
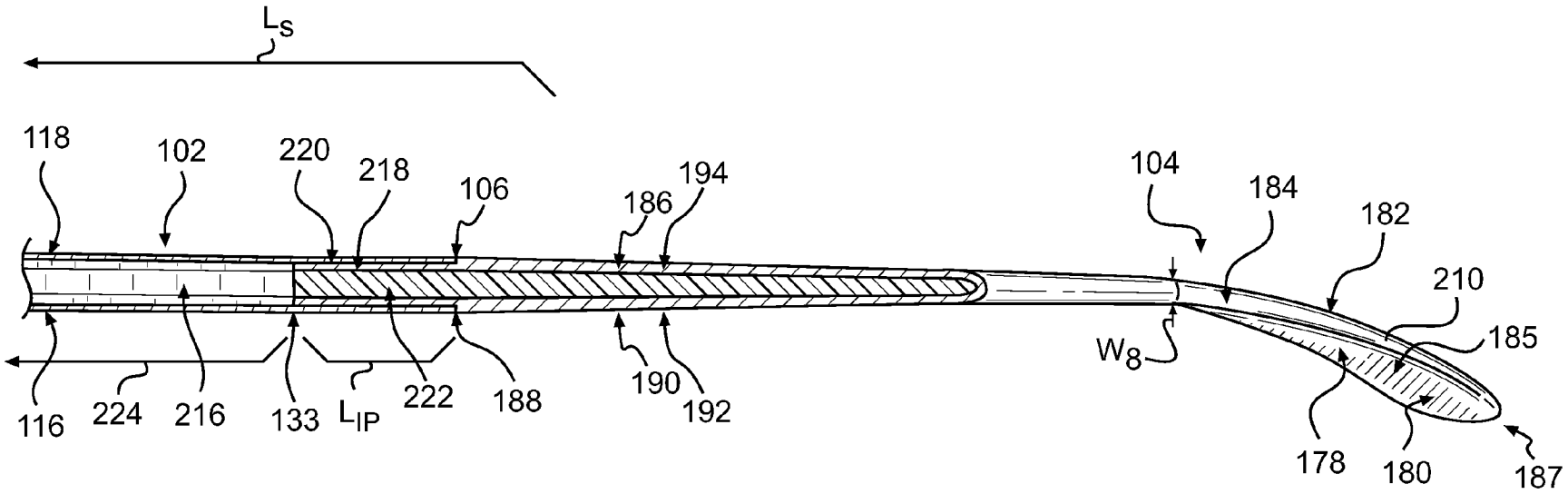
FIG. 22 is a left side elevation close-up view the portion indicated by bracket 22 of the shaft and blade of the ice hockey stick of FIG. 1 with a portion cut away to show the interior thereof.

Referring to FIG. 22, in the present embodiment, the shaft 102 is hollow, having a generally uniform wall thickness of approximately 2 mm. Thus the inner surface 216 of the shaft has approximately the same cross-sectional shape as the outer surface 110 of the shaft 102 at that point on the longitudinal length of the shaft 102. However, the corners thereof are more rounded than those of the outer surface 110.

Blade

Referring back to FIGS. 1 to 3 and 21 to 26, adjoining the proximal end 106 of the shaft 102 is a blade 104. The blade 104 has a front face 178 having the puck striking surface 180 of the stick. (The identification of the puck striking surface is evident to any person skilled in the art, as well as to anyone who has played the game of ice hockey.) The front face 178 of the blade 104 is flush with the front face 116 of the shaft 102. Opposite the front face 178 of the blade 104 is the rear face 182 of the blade 104. The rear face 182 of the blade 104 is flush with the rear face 118 of the shaft 102. The blade has a body 185 having a heel 184, which is the portion of the bottom end of the body 185 of the blade 104 directly below where the blade 104 and the shaft 102 meet. (Opposite the heel 184 is the tip 187, which is the end of the body 185 of the blade 104 away from the shaft 102.) The blade also has a neck 186 extending up from the body 185 to meet the proximal end 106 of the shaft 102. The neck 186 is affixed to the proximal end 106 of the shaft 102, in this embodiment in a manner described hereinbelow. In FIGS. 1, 2, 3, 12, 13, and 14 connection point 188 is shown as a solid line perpendicular to the longitudinal length of the shaft 102. This is merely for purposes of illustration and such a distinctive line is not present in the actual physical embodiment, although it is in others.

Figure 23:
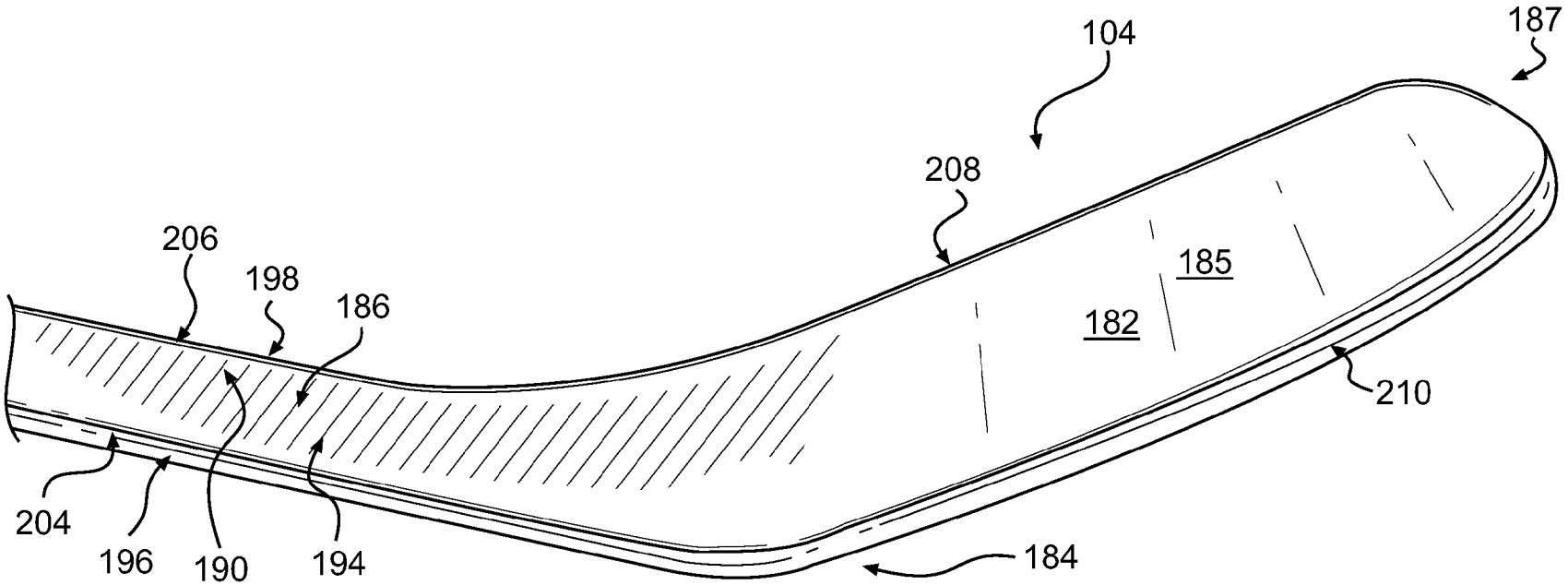
FIG. 23 is a left rear close-up perspective view of the portion indicated by bracket 22 of the shaft and blade of the ice hockey stick of FIG. 2.
Figure 24:
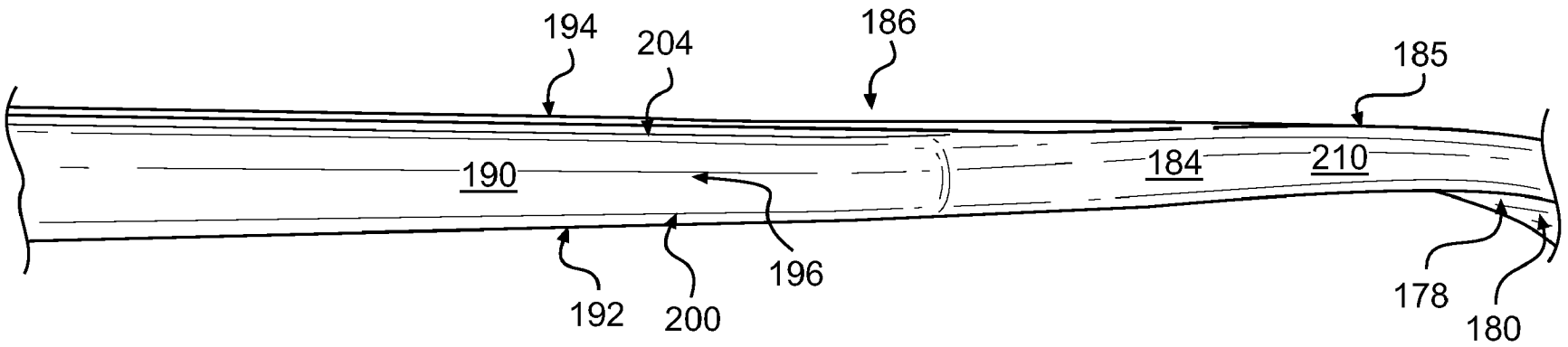
FIG. 24 is a left side elevation view of the portion of the ice hockey stick shown in FIG. 22.
Figure 25:
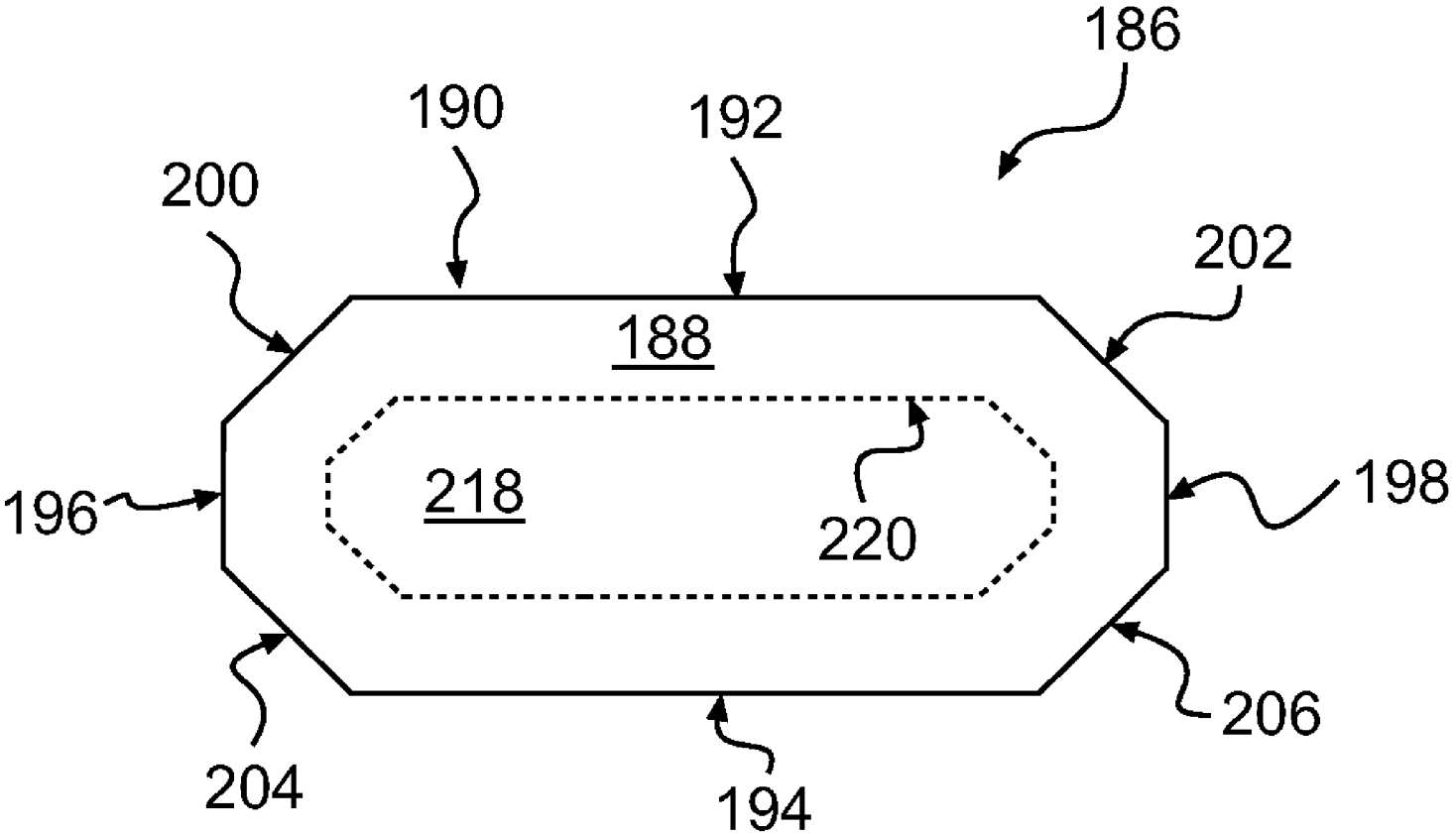
FIG. 25 is top view of the neck of the blade of the ice hockey stick of FIG. 1 shown apart from the body of the blade and the shaft of the ice hockey stick of FIG. 1, and the insert portion having been removed (the approximate position thereof being shown in dotted lines), all for ease of understanding.
Figure 26:
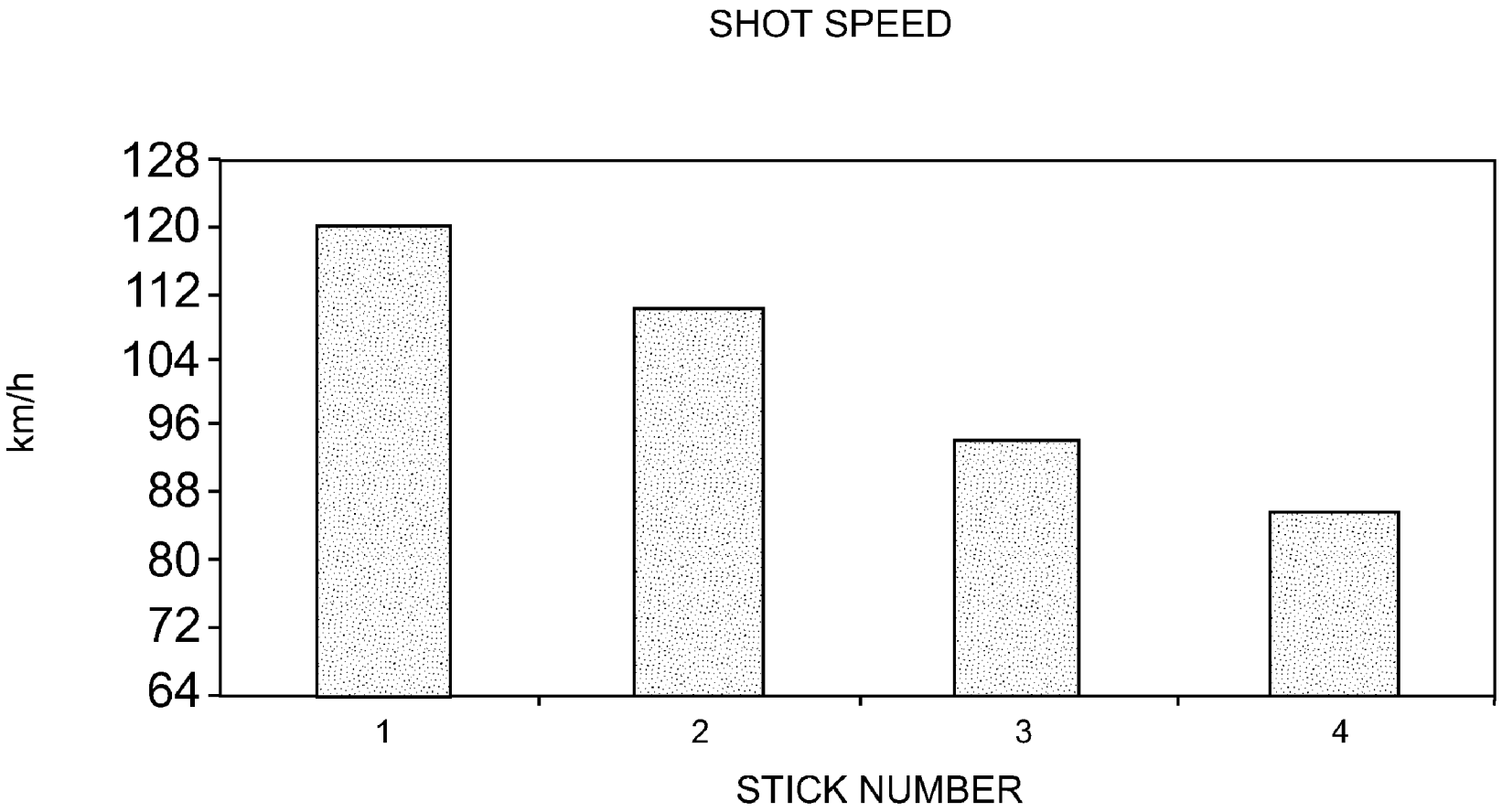
FIG. 26 is a graph of results of a test comparing the maximum shot speed of various embodiments of the present invention and a conventional ice hockey stick.

Referring to FIGS. 23 and 24, in this embodiment, the neck 186 has an outer surface 190 that is designed to have an appearance such that is a continuation of the outer surface 110 of the shaft 102. Thus in cross-section, as is shown in FIG. 25, the outer surface 190 of the neck 186 at the point 188 where the neck 186 joins the shaft 102 is generally octagonal in shape and is identical to the proximal end 106 of the shaft in outer surface cross-sectional shape. Thus the neck 186 has a front face 192 (being a portion of the front face 178 of the blade 104), a rear face 194 (being a portion of the rear face 182 of the blade 104), a left face 196 and right face 198. The neck 186 also has a front left diagonal face 200, a front right diagonal face 202, a rear left diagonal face 204, and a rear right diagonal face 206, which are each flush with one of the corresponding (although not individually identified as such) diagonal shaft faces 174 of the shaft 102.

In this embodiment, the gradual progressive taper of the width of the shaft (having stopped at point 133) resumes on neck 186 of the blade 104 (at the connection point 188 of the neck 186 with the proximal end 106 of the shaft) and continues uninterrupted through neck 186 of the blade 104 to the heel 184 of the blade 104 in the same manner as through the shaft 102. Thus, referring to FIG. 22, the width of the "continuation of the shaft 102 into the blade 104", as measured between the front face 178 of the blade 104 and the rear face 182 of the blade 104 is at a minimum at the heel 184 of the blade 104 ($W_8$). Additionally, the body 184 of the blade 104 tapers from the heel 184 to the tip 187.

At the juncture of the neck 186 with the body 185 of the blade 104, the various right faces of the neck 186 (i.e. the front right diagonal face 202, the right face 198, and the rear right diagonal face 206) all merge into the top edge 208 of the body 185 of the blade 104. The various left faces of the neck 186 (i.e. the front left diagonal face 200, the left face 196, the rear left diagonal face 204) all merge at the heel 184 into the bottom edge 210 of the body 185 of the blade.

In this embodiment, extending from (and included for the purposes of the present specification as a part of) the neck 186 is an insert portion 218. The insert portion 218 is so named as it is the portion of the neck that is inserted in to the proximal end 106 of the shaft during manufacture of the stick 100, as is described in further detail hereinbelow. The insert portion 218 has an outer surface 220 that is configured to mate with the inner surface 216 of the proximal end 106 of the shaft 102. Thus in this embodiment the shape of the outer surface 220 of the insert portion 218 in cross-section is generally octagonal, being of constant width. As can be seen in FIG. 22, in this embodiment, the insert portion 218 is filled with foam 222. In other embodiments, insert portion 218 is solid or hollow.

Referring still to FIG. 22, the longitudinal length $L_{IP}$ of the insert portion 218 of the neck 186 in this embodiment is approximately 50-51 mm. Thus, given the longitudinal length of the shank $L_S$ there is a (relatively long in this embodiment) portion 224 of the shaft 102 that is not underlapped by the insert portion 218 of the neck 186 when the insert portion 218 has been inserted into the proximal end 106 of the shaft 102. The importance of this being the case as been described elsewhere in this specification.

Manufacturing of the Stick

In the present embodiment both the shaft 102 and the blade 104 are manufactured from a fibre-reinforced polymer composite. They are separately manufactured according to conventional methods of manufacturing shafts and blades made of fibre-reinforced polymer composites, with the exception being that the molds are designed so as to impart to the final products the geometric characteristics of the present invention as described in this specification.

Once manufactured, the stick 100 is assembled in accordance with conventional techniques, i.e. the outer surface 220 of the insert portion 218 is coated with a chemical fastener compatible with the polymer composite system. Examples of chemical fasteners include, but are not limited to, epoxy, vinyl, ester, acrylic, and thermoplastic based polymers. The coated insert portion is inserted into and bonded to the inner surface 216 of the proximal end 106 of the shaft 102. The stick is then processed according to conventional methods to yield a final commercial product.

Test Data

In order to validate the inventors' theory that the longitudinal length of the insert portion of the neck of the blade has an effect on the maximum shot speed of an ice hockey stick of the present invention, a test using several sticks embodying the present invention and a conventional stick were conducted. Referring to the graph in FIG. 27, Sticks 1, 2, and 3 were each ice hockey sticks embodying the present invention constructed in accordance with the teachings of the present specification and having the dimensions of the preferred embodiment described herein and having the following insert portion longitudinal lengths:

| | |
|---|---|
| Stick 1 | 38 mm long insert portion |
| Stick 2 | 46 mm long insert portion |
| Stick 3 | 51 mm long insert portion |

Stick 4 was a similar, albeit conventional, commercially available ice hockey stick sold by Reebok-CCM Hockey under the trademark CCM V10, having a 57 mm long insert portion. All of the sticks tested were manufactured of the same materials. All of the tests were conducted using the same six hockey players. The results being the average maximum shot speed of 30 shots with each stick (five shots by each one of the six players).

The results of the test are set forth in the graph found in FIG. 27, the may be summarized as follows:

| | | |
|---|---|---|
| Stick 1 | invention (38 mm long insert portion) | 120 km/h max shot speed |
| Stick 2 | invention (46 mm long insert portion) | 111 km/h max shot speed |
| Stick 3 | invention (51 mm long insert portion) | 95 km/h max shot speed |
| Stick 4 | conventional (57 mm long insert portion) | 86 km/h max shot speed |

A comparison of the results shows that: (1) the shorter the longitudinal length of the insert portion the faster the maximum shot speed of the stick in a stick with an octagonal portion as described herein; and (2) all of the sticks (no matter what their insert portion longitudinal length) being embodiments of the invention had a faster maximum shot speed than a stick of conventional design made with the same raw materials.

Other

It should be noted that the present embodiment has been described as having a shaft 102 that is generally rectangular towards the distal end 108 and generally octagonal towards the proximal end 106. This should not be interpreted as a limitation on the scope of the present invention as set forth in the Summary of the Invention section of this specification. In other embodiments of the present invention, the shaft is (at least) generally hexagonal towards the proximal end. In still other embodiments of the present invention, the shaft is (at least) generally decagonal towards the proximal end. In still other embodiments of the present invention, the shaft is (at least) generally dodecagonal towards the proximal end. In yet other embodiments of the present invention, the shaft is (at least) a combination of at least two of generally hexagonal, octagonal, decagonal, or dodecagonal. Further, in this embodiment the neck of the blade has the same outer surface cross-sectional shape as the proximal end. In other embodiments, this is not the case. In some such other embodiments, the neck transitions to a generally rectangular shape before joining the body of the blade. Detailed descriptions of all of these embodiments (and others) are not included in the present specification with a view to brevity (and thus ease of understanding) as their making is readily within the skill of a person skilled in the art upon having read and understood the present specification.

Finally, as a reminder, additional modifications and improvements to the above-described embodiment(s) of the present invention would be apparent to those skilled in the art. The foregoing description is intended to be exemplary rather than limiting. The scope of the present invention is intended to be defined solely by the appended claims.

What is claimed is:

1. An ice hockey stick comprising:

a shaft and an adjoining blade, the shaft having a proximal end proximate the blade, a distal end opposite the proximal end, an outer surface having a generally rectangular cross-sectional shape transitioning towards the proximal end to one of a generally hexagonal, octagonal, decagonal, or dodecagonal cross-sectional shape, and a front shaft face and an opposing rear shaft face, a width of a portion of the shaft, as measured between the front shaft face and the rear shaft face, tapering towards the proximal end; and the blade having a front blade face being flush with the front shaft face, a rear blade face, opposing the front blade face, the rear blade face being flush with the rear shaft face, a heel, and a neck affixed to the proximal end of the shaft.

2. The ice hockey stick of claim 1, wherein the shaft defines a handle and a shank, and it is at least the width of a portion of the shank that tapers and it is at least a portion of the outer surface of the shank that is the one of generally hexagonal, octagonal, decagonal, or dodecagonal in cross-sectional shape.

3. The ice hockey stick of claim 2, wherein an entirety of the shank is the one of generally hexagonal, octagonal, decagonal, or dodecagonal in cross-sectional shape.

4. The ice hockey stick of claim 3, wherein the generally rectangular cross-sectional shape of the outer surface begins at the distal end and transitions across an intermediate portion of the shaft to the one of the generally hexagonal, octagonal, decagonal, or dodecagonal cross-sectional shape and remains so shaped until the proximal end.

5. The ice hockey stick of claim 4, wherein the neck of the blade is of the same cross-sectional shape as the proximal end of the shaft.

6. The ice hockey stick of claim 5, wherein the taper of the width of the shaft continues to the proximal end of the shaft, through the neck of the blade, to the heel of the blade.

7. The ice hockey stick of claim 6, wherein the shaft further comprises a left shaft face and an opposing right shaft face, and a depth of the shaft, as measured between the left shaft face and the right shaft face, is generally constant throughout an entire length of the shaft.

8. The ice hockey stick of claim 7, wherein the one of the generally hexagonal, octagonal, decagonal, or dodecagonal in cross-sectional shape is an octagonal cross-sectional shape.

9. The ice hockey stick of claim 8, wherein the octagonal cross-sectional shape has four pairs of opposing sides including a front side forming part of the front shaft face and a rear side forming part of the rear shaft face, and a distance between each of the other three pairs of the opposing sides exceeds a distance between the front side and a rear side by a range of about 40% to about 200%.

10. The ice hockey stick of claim 1, wherein the neck has an insert portion inserted inside the proximal end of the shaft, the insert portion having a longitudinal length of less than about 60 mm; and there is a portion of the shaft not underlapped by the insert portion that is tapering in width and has an outer surface being the one of generally hexagonal, octagonal, decagonal, or dodecagonal in cross-sectional shape.

11. The ice hockey stick of claim 10, wherein the insert portion has a longitudinal length of less than about 50 mm.

12. The ice hockey stick of claim 11, wherein the insert portion has a longitudinal length of less than about 40 mm.

13. The ice hockey stick of claim 12, wherein the insert portion has a longitudinal length of less than about 25 mm.

14. The ice hockey stick of claim 10, wherein the shaft has a hollow interior.

15. The ice hockey stick of claim 14, wherein the insert portion of the blade is affixed to the hollow interior of the shaft at portions of each one thereof having mating cross-sectional shapes of a same shape as the one of the generally hexagonal, octagonal, decagonal, or dodecagonal cross-sectional shape.

16. The ice hockey stick of claim 15, wherein the insert portion of the blade is filled with foam.

17. The ice hockey stick of claim 1, wherein the outer surface begins transitioning to the one of the generally hexagonal, octagonal, decagonal, or dodecagonal cross-sectional shape at a distance from the proximal end of the shaft being between about 28% to about 38% of a total length of the shaft.

18. The ice hockey stick of claim 1, wherein the neck of the blade has an end that is connected to the proximate end of the shaft, there being no portion of the neck inserted inside the proximate end of the shaft.

19. The ice hockey stick of claim 18, wherein the shaft and the blade are formed of the same material.

20. The ice hockey stick of claim 19, wherein the shaft and the blade are unitarily formed.

21. An ice hockey stick comprising:

a shaft and an adjoining blade, the shaft having a proximal end proximate the blade, a distal end opposite the proximal end, an outer surface having a generally rectangular cross-sectional shape transitioning towards the proximal end to one of a generally hexagonal, octagonal, decagonal, or dodecagonal cross-sectional shape; and the blade having a front blade face being flush with the front shaft face, rear blade face, opposing the front blade face, the rear blade face being flush with the rear shaft face, a heel, and a neck having an insert portion inserted inside the proximal end of the shaft and affixed thereto, the insert portion having a longitudinal length of less than about 60 mm.

* * * * *